US010968781B2

(12) United States Patent
Pakkala

(10) Patent No.: US 10,968,781 B2
(45) Date of Patent: Apr. 6, 2021

(54) SYSTEM AND METHOD FOR COOLING DISCHARGE FLOW

(71) Applicants: General Electric Company, Schenectady, NY (US); ExxonMobil Upstream Research Company, Spring, TX (US)

(72) Inventor: Srinivas Pakkala, Chintalapudi (IN)

(73) Assignees: General Electric Company, Schenectady, NY (US); ExxonMobil Upstream Research Company, Spring, TX (US)

( * ) Notice: Subject to any disclaimer, the term of this patent is extended or adjusted under 35 U.S.C. 154(b) by 203 days.

(21) Appl. No.: 16/208,160

(22) Filed: Dec. 3, 2018

(65) Prior Publication Data

US 2019/0093517 A1 Mar. 28, 2019

Related U.S. Application Data

(63) Continuation of application No. 15/060,089, filed on Mar. 3, 2016, now Pat. No. 10,145,269.
(Continued)

(51) Int. Cl.
*F01D 25/12* (2006.01)
*F01D 25/30* (2006.01)
(Continued)

(52) U.S. Cl.
CPC ..... *F01D 25/305* (2013.01); *F01D 25/12* (2013.01); *F23N 5/003* (2013.01); *F23N 5/006* (2013.01);
(Continued)

(58) Field of Classification Search
CPC ..... F01D 25/305; F01D 25/12; F23N 5/003; F23N 5/006; F23N 5/022; F23N 2900/05005; F05D 2270/80
See application file for complete search history.

(56) References Cited

U.S. PATENT DOCUMENTS 2,488,911 A 11/1949 Hepburn et al.
2,884,758 A 5/1959 Oberle
(Continued)

FOREIGN PATENT DOCUMENTS

CA 2231749 9/1998
CA 2645450 9/2007
(Continued)

OTHER PUBLICATIONS

PCT International Search Report and Written Opinion; Application No. PCT/US2016/020878; dated Jul. 7, 2016; 12 pages.
(Continued)

*Primary Examiner* — Steven M Sutherland
(74) *Attorney, Agent, or Firm* — Fletcher Yoder, P.C.

(57) ABSTRACT

A system includes a probe disposed through one or more walls of a turbomachine. The probe includes a sensing component configured to sense a parameter of the turbomachine. The probe also includes a body coupled to the sensing component, an inlet configured to receive a cooling inflow, a shell that defines a cooling passage, and an outlet. The sensing component is disposed on a warm side of the one or more walls. The inlet and the outlet are disposed on a cool side of the one or more walls. The cooling passage directs the cooling inflow toward the sensing component and toward the outlet. The outlet is configured to receive an outflow from the cooling passage, wherein the outflow includes at least a portion of the cooling inflow.

17 Claims, 8 Drawing Sheets

Related U.S. Application Data

(60) Provisional application No. 62/128,337, filed on Mar. 4, 2015.

(51) Int. Cl.
*F23N 5/00* (2006.01)
*F23N 5/02* (2006.01)

(52) U.S. Cl.
CPC ..... *F23N 5/022* (2013.01); *F05D 2260/232* (2013.01); *F05D 2270/80* (2013.01); *F23N 2900/05005* (2013.01)

(56) References Cited

U.S. PATENT DOCUMENTS 3,631,672 A 1/1972 Gentile et al.
3,641,766 A 2/1972 Uehling
3,643,430 A 2/1972 Emory et al.
3,705,492 A 12/1972 Vickers
3,841,382 A 10/1974 Gravis et al.
3,949,548 A 4/1976 Lockwood
4,018,046 A 4/1977 Hurley
4,043,395 A 8/1977 Every et al.
4,050,239 A 9/1977 Kappler et al.
4,066,214 A 1/1978 Johnson
4,077,206 A 3/1978 Ayyagari
4,085,578 A 4/1978 Kydd
4,092,095 A 5/1978 Straitz
4,101,294 A 7/1978 Kimura
4,112,676 A 9/1978 DeCorso
4,117,671 A 10/1978 Neal et al.
4,160,640 A 7/1979 Maev et al.
4,165,609 A 8/1979 Rudolph
4,171,349 A 10/1979 Cucuiat et al.
4,204,401 A 5/1980 Earnest
4,222,240 A 9/1980 Castellano
4,224,991 A 9/1980 Sowa et al.
4,236,378 A 12/1980 Vogt
4,253,301 A 3/1981 Vogt
4,271,664 A 6/1981 Earnest
4,344,486 A 8/1982 Parrish
4,345,426 A 8/1982 Egnell et al.
4,352,269 A 10/1982 Dineen
4,380,895 A 4/1983 Adkins
4,399,652 A 8/1983 Cole et al.
4,414,334 A 11/1983 Hitzman
4,434,613 A 3/1984 Stahl
4,435,153 A 3/1984 Hashimoto et al.
4,442,665 A 4/1984 Fick et al.
4,445,842 A 5/1984 Syska
4,479,484 A 10/1984 Davis
4,480,985 A 11/1984 Davis
4,488,865 A 12/1984 Davis
4,498,288 A 2/1985 Vogt
4,498,289 A 2/1985 Osgerby
4,528,811 A 7/1985 Stahl
4,543,784 A 10/1985 Kirker
4,548,034 A 10/1985 Maguire
4,561,245 A 12/1985 Ball
4,569,310 A 2/1986 Davis
4,577,462 A 3/1986 Robertson
4,602,614 A 7/1986 Percival et al.
4,606,721 A 8/1986 Livingston
4,613,299 A 9/1986 Backheim
4,637,792 A 1/1987 Davis
4,651,712 A 3/1987 Davis
4,653,278 A 3/1987 Vinson et al.
4,681,678 A 7/1987 Leaseburge et al.
4,684,465 A 8/1987 Leaseburge et al.
4,753,666 A 6/1988 Pastor et al.
4,762,543 A 8/1988 Pantermuehl et al.
4,817,387 A 4/1989 Lashbrook
4,858,428 A 8/1989 Paul
4,895,710 A 1/1990 Hartmann et al.
4,898,001 A 2/1990 Kuroda et al.
4,946,597 A 8/1990 Sury
4,976,100 A 12/1990 Lee
5,014,785 A 5/1991 Puri et al.
5,044,932 A 9/1991 Martin et al.
5,073,105 A 12/1991 Martin et al.
5,084,438 A 1/1992 Matsubara et al.
5,085,274 A 2/1992 Puri et al.
5,098,282 A 3/1992 Schwartz et al.
5,123,248 A 6/1992 Monty et al.
5,135,387 A 8/1992 Martin et al.
5,141,049 A 8/1992 Larsen et al.
5,142,866 A 9/1992 Yanagihara et al.
5,147,111 A 9/1992 Montgomery
5,154,596 A 10/1992 Schwartz et al.
5,183,232 A 2/1993 Gale
5,195,884 A 3/1993 Schwartz et al.
5,197,289 A 3/1993 Glevicky et al.
5,209,284 A 5/1993 Okamoto et al.
5,238,395 A 8/1993 Schwartz et al.
5,255,506 A 10/1993 Wilkes et al.
5,265,410 A 11/1993 Hisatome
5,271,905 A 12/1993 Owen et al.
5,275,552 A 1/1994 Schwartz et al.
5,295,350 A 3/1994 Child et al.
5,304,362 A 4/1994 Madsen
5,325,660 A 7/1994 Taniguchi et al.
5,332,036 A 7/1994 Shirley et al.
5,344,307 A 9/1994 Schwartz et al.
5,345,756 A 9/1994 Jahnke et al.
5,352,087 A 10/1994 Antonellis
5,355,668 A 10/1994 Weil et al.
5,359,847 A 11/1994 Pillsbury et al.
5,361,586 A 11/1994 McWhirter et al.
5,388,395 A 2/1995 Scharpf et al.
5,394,688 A 3/1995 Amos
5,402,847 A 4/1995 Wilson et al.
5,444,971 A 8/1995 Holenberger
5,457,951 A 10/1995 Johnson et al.
5,458,481 A 10/1995 Surbey et al.
5,468,270 A 11/1995 Borszynski
5,490,378 A 2/1996 Berger et al.
5,542,840 A 8/1996 Surbey et al.
5,566,756 A 10/1996 Chaback et al.
5,572,862 A 11/1996 Mowill
5,581,998 A 12/1996 Craig
5,584,182 A 12/1996 Althaus et al.
5,590,518 A 1/1997 Janes
5,628,182 A 5/1997 Mowill
5,634,329 A 6/1997 Andersson et al.
5,638,675 A 6/1997 Zysman et al.
5,640,840 A 6/1997 Briesch
5,657,631 A 8/1997 Androsov
5,680,764 A 10/1997 Viteri
5,685,158 A 11/1997 Lenahan et al.
5,709,077 A 1/1998 Beichel
5,713,206 A 2/1998 McWhirter et al.
5,715,673 A 2/1998 Beichel
5,720,434 A 2/1998 Vdoviak et al.
5,724,805 A 3/1998 Golomb et al.
5,725,054 A 3/1998 Shayegi et al.
5,740,786 A 4/1998 Gartner
5,743,079 A 4/1998 Walsh et al.
5,765,363 A 6/1998 Mowill
5,771,867 A 6/1998 Amstutz et al.
5,771,868 A 6/1998 Khair
5,775,589 A 7/1998 Vdoviak et al.
5,819,540 A 10/1998 Massarani
5,832,712 A 11/1998 Ronning et al.
5,836,164 A 11/1998 Tsukahara et al.
5,839,283 A 11/1998 Dobbeling
5,850,732 A 12/1998 Willis et al.
5,894,720 A 4/1999 Willis et al.
5,901,547 A 5/1999 Smith et al.
5,924,275 A 7/1999 Cohen et al.
5,930,990 A 8/1999 Zachary et al.
5,937,634 A 8/1999 Etheridge et al.
5,950,417 A 9/1999 Robertson et al.
5,956,937 A 9/1999 Beichel
5,968,349 A 10/1999 Duyvesteyn et al.

(56) References Cited

U.S. PATENT DOCUMENTS 5,974,780 A 11/1999 Santos
5,992,388 A 11/1999 Seger
6,016,658 A 1/2000 Willis et al.
6,032,465 A 3/2000 Regnier
6,035,641 A 3/2000 Lokhandwala
6,062,026 A 5/2000 Woollenweber et al.
6,079,974 A 6/2000 Thompson
6,082,093 A 7/2000 Greenwood et al.
6,089,855 A 7/2000 Becker et al.
6,094,916 A 8/2000 Puri et al.
6,101,983 A 8/2000 Anand et al.
6,148,602 A 11/2000 Demetri
6,170,264 B1 1/2001 Viteri et al.
6,183,241 B1 2/2001 Bohn et al.
6,201,029 B1 3/2001 Waycuilis
6,202,400 B1 3/2001 Utamura et al.
6,202,442 B1 3/2001 Brugerolle
6,202,574 B1 3/2001 Liljedahl et al.
6,209,325 B1 4/2001 Alkabie
6,216,459 B1 4/2001 Daudel et al.
6,216,549 B1 4/2001 Davis et al.
6,230,103 B1 5/2001 DeCorso et al.
6,237,339 B1 5/2001 Åsen et al.
6,247,315 B1 6/2001 Marin et al.
6,247,316 B1 6/2001 Viteri
6,248,794 B1 6/2001 Gieskes
6,253,555 B1 7/2001 Willis
6,256,976 B1 7/2001 Kataoka et al.
6,256,994 B1 7/2001 Dillon, IV
6,263,659 B1 7/2001 Dillon, IV et al.
6,266,954 B1 7/2001 McCallum et al.
6,269,882 B1 8/2001 Wellington et al.
6,276,171 B1 8/2001 Brugerolle
6,282,901 B1 9/2001 Marin et al.
6,283,087 B1 9/2001 Isaksen
6,289,677 B1 9/2001 Prociw et al.
6,298,652 B1 10/2001 Mittricker et al.
6,298,654 B1 10/2001 Vermes et al.
6,298,664 B1 10/2001 Åsen et al.
6,301,877 B1 10/2001 Liang et al.
6,301,888 B1 10/2001 Gray
6,301,889 B1 10/2001 Gladden et al.
6,305,929 B1 10/2001 Chung et al.
6,314,721 B1 11/2001 Mathews et al.
6,324,867 B1 12/2001 Fanning et al.
6,332,313 B1 12/2001 Willis et al.
6,345,493 B1 2/2002 Smith et al.
6,360,528 B1 3/2002 Brausch et al.
6,363,709 B2 4/2002 Kataoka et al.
6,367,258 B1 4/2002 Wen et al.
6,370,870 B1 4/2002 Kamijo et al.
6,374,591 B1 4/2002 Johnson et al.
6,374,594 B1 4/2002 Kraft et al.
6,383,461 B1 5/2002 Lang
6,389,814 B2 5/2002 Viteri et al.
6,405,536 B1 6/2002 Ho et al.
6,412,270 B1 7/2002 Mortzheim et al.
6,412,278 B1 7/2002 Matthews
6,412,302 B1 7/2002 Foglietta
6,412,559 B1 7/2002 Gunter et al.
6,418,725 B1 7/2002 Maeda et al.
6,429,020 B1 8/2002 Thornton et al.
6,449,954 B2 9/2002 Bachmann
6,450,256 B2 9/2002 Mones
6,461,147 B1 10/2002 Sonju et al.
6,467,270 B2 10/2002 Mulloy et al.
6,470,682 B2 10/2002 Gray
6,477,859 B2 11/2002 Wong et al.
6,484,503 B1 11/2002 Raz
6,484,507 B1 11/2002 Pradt
6,487,863 B1 12/2002 Chen et al.
6,499,990 B1 12/2002 Zink et al.
6,502,383 B1 1/2003 Janardan et al.
6,505,567 B1 1/2003 Anderson et al.
6,505,683 B2 1/2003 Minkkinen et al.
6,508,209 B1 1/2003 Collier
6,523,349 B2 2/2003 Viteri
6,532,745 B1 3/2003 Neary
6,539,716 B2 4/2003 Finger et al.
6,584,775 B1 7/2003 Schneider et al.
6,598,398 B2 7/2003 Viteri et al.
6,598,399 B2 7/2003 Liebig
6,598,402 B2 7/2003 Kataoka et al.
6,606,861 B2 8/2003 Snyder
6,612,291 B2 9/2003 Sakamoto
6,615,576 B2 9/2003 Sheoran et al.
6,615,589 B2 9/2003 Allam et al.
6,622,470 B2 9/2003 Viteri et al.
6,622,645 B2 9/2003 Havlena
6,637,183 B2 10/2003 Viteri et al.
6,644,041 B1 11/2003 Eyermann
6,655,150 B1 12/2003 Åsen et al.
6,668,541 B2 12/2003 Rice et al.
6,672,863 B2 1/2004 Doebbeling et al.
6,675,579 B1 1/2004 Yang
6,684,643 B2 2/2004 Frutschi
6,694,735 B2 2/2004 Sumser et al.
6,698,412 B2 3/2004 Betta
6,702,570 B2 3/2004 Shah et al.
6,722,436 B2 4/2004 Krill
6,725,665 B2 4/2004 Tuschy et al.
6,731,501 B1 5/2004 Cheng
6,732,531 B2 5/2004 Dickey
6,742,506 B1 6/2004 Grandin
6,743,829 B2 6/2004 Fischer-Calderon et al.
6,745,573 B2 6/2004 Marin et al.
6,745,624 B2 6/2004 Porter et al.
6,748,004 B2 6/2004 Jepson
6,752,620 B2 6/2004 Heier et al.
6,767,527 B1 7/2004 Åsen et al.
6,772,583 B2 8/2004 Bland
6,790,030 B2 9/2004 Fischer et al.
6,805,483 B2 10/2004 Tomlinson et al.
6,810,673 B2 11/2004 Snyder
6,813,889 B2 11/2004 Inoue et al.
6,817,187 B2 11/2004 Yu
6,820,428 B2 11/2004 Wylie
6,821,501 B2 11/2004 Matzakos et al.
6,823,852 B2 11/2004 Collier
6,824,710 B2 11/2004 Viteri et al.
6,826,912 B2 12/2004 Levy et al.
6,826,913 B2 12/2004 Wright
6,838,071 B1 1/2005 Olsvik et al.
6,851,413 B1 2/2005 Tamol
6,868,677 B2 3/2005 Viteri et al.
6,886,334 B2 5/2005 Shirakawa
6,887,069 B1 5/2005 Thornton et al.
6,899,859 B1 5/2005 Olsvik
6,901,760 B2 6/2005 Dittmann et al.
6,904,815 B2 6/2005 Widmer
6,907,737 B2 6/2005 Mittricker et al.
6,910,335 B2 6/2005 Viteri et al.
6,923,915 B2 8/2005 Alford et al.
6,939,130 B2 9/2005 Abbasi et al.
6,945,029 B2 9/2005 Viteri
6,945,052 B2 9/2005 Frutschi et al.
6,945,087 B2 9/2005 Porter et al.
6,945,089 B2 9/2005 Barie et al.
6,946,419 B2 9/2005 Kaefer
6,969,123 B2 11/2005 Vinegar et al.
6,971,242 B2 12/2005 Boardman
6,981,358 B2 1/2006 Bellucci et al.
6,988,549 B1 1/2006 Babcock
6,993,901 B2 2/2006 Shirakawa
6,993,916 B2 2/2006 Johnson et al.
6,994,491 B2 2/2006 Kittle
7,007,487 B2 3/2006 Belokon et al.
7,010,921 B2 3/2006 Intile et al.
7,011,154 B2 3/2006 Maher et al.
7,015,271 B2 3/2006 Bice et al.
7,032,388 B2 4/2006 Healy
7,040,400 B2 5/2006 de Rouffignac et al.
7,043,898 B2 5/2006 Rago
7,043,920 B2 5/2006 Viteri et al.

(56) References Cited

U.S. PATENT DOCUMENTS

| | | | |
|---|---|---|---|
| 7,045,553 | B2 | 5/2006 | Hershkowitz |
| 7,053,128 | B2 | 5/2006 | Hershkowitz |
| 7,056,482 | B2 | 6/2006 | Hakka et al. |
| 7,059,152 | B2 | 6/2006 | Oakey et al. |
| 7,063,097 | B2 | 6/2006 | Arno et al. |
| 7,065,953 | B1 | 6/2006 | Kopko |
| 7,065,972 | B2 | 6/2006 | Zupanc et al. |
| 7,074,033 | B2 | 7/2006 | Neary |
| 7,077,199 | B2 | 7/2006 | Vinegar et al. |
| 7,089,743 | B2 | 8/2006 | Frutschi et al. |
| 7,096,942 | B1 | 8/2006 | de Rouffignac et al. |
| 7,097,925 | B2 | 8/2006 | Keefer |
| 7,104,319 | B2 | 9/2006 | Vinegar et al. |
| 7,104,784 | B1 | 9/2006 | Hasegawa et al. |
| 7,124,589 | B2 | 10/2006 | Neary |
| 7,137,256 | B1 | 11/2006 | Stuttaford et al. |
| 7,137,623 | B2 | 11/2006 | Mockry et al. |
| 7,143,572 | B2 | 12/2006 | Ooka et al. |
| 7,143,606 | B2 | 12/2006 | Tranier |
| 7,146,969 | B2 | 12/2006 | Weirich |
| 7,147,461 | B2 | 12/2006 | Neary |
| 7,148,261 | B2 | 12/2006 | Hershkowitz et al. |
| 7,152,409 | B2 | 12/2006 | Yee et al. |
| 7,162,875 | B2 | 1/2007 | Fletcher et al. |
| 7,168,265 | B2 | 1/2007 | Briscoe et al. |
| 7,168,395 | B2 | 1/2007 | Engdahl |
| 7,168,488 | B2 | 1/2007 | Olsvik et al. |
| 7,183,328 | B2 | 2/2007 | Hershkowitz et al. |
| 7,185,497 | B2 | 3/2007 | Dudebout et al. |
| 7,194,869 | B2 | 3/2007 | McQuiggan et al. |
| 7,197,880 | B2 | 4/2007 | Thornton et al. |
| 7,217,303 | B2 | 5/2007 | Hershkowitz et al. |
| 7,225,623 | B2 | 6/2007 | Koshoffer |
| 7,237,385 | B2 | 7/2007 | Carrea |
| 7,284,362 | B2 | 10/2007 | Marin et al. |
| 7,299,619 | B2 | 11/2007 | Briesch et al. |
| 7,299,868 | B2 | 11/2007 | Zapadinski |
| 7,302,801 | B2 | 12/2007 | Chen |
| 7,305,817 | B2 | 12/2007 | Blodgett et al. |
| 7,305,831 | B2 | 12/2007 | Carrea et al. |
| 7,313,916 | B2 | 1/2008 | Pellizzari |
| 7,318,317 | B2 | 1/2008 | Carrea |
| 7,343,742 | B2 | 3/2008 | Wimmer et al. |
| 7,353,655 | B2 | 4/2008 | Bolis et al. |
| 7,357,857 | B2 | 4/2008 | Hart et al. |
| 7,363,756 | B2 | 4/2008 | Carrea et al. |
| 7,363,764 | B2 | 4/2008 | Griffin et al. |
| 7,381,393 | B2 | 6/2008 | Lynn |
| 7,401,577 | B2 | 7/2008 | Saucedo et al. |
| 7,410,525 | B1 | 8/2008 | Liu et al. |
| 7,416,137 | B2 | 8/2008 | Hagen et al. |
| 7,427,311 | B2 | 9/2008 | Burtscher et al. |
| 7,434,384 | B2 | 10/2008 | Lord et al. |
| 7,438,744 | B2 | 10/2008 | Beaumont |
| 7,467,942 | B2 | 12/2008 | Carroni et al. |
| 7,468,173 | B2 | 12/2008 | Hughes et al. |
| 7,472,550 | B2 | 1/2009 | Lear et al. |
| 7,481,048 | B2 | 1/2009 | Harmon et al. |
| 7,481,275 | B2 | 1/2009 | Olsvik et al. |
| 7,482,500 | B2 | 1/2009 | Johann et al. |
| 7,485,761 | B2 | 2/2009 | Schindler et al. |
| 7,488,857 | B2 | 2/2009 | Johann et al. |
| 7,490,472 | B2 | 2/2009 | Lynghjem et al. |
| 7,491,250 | B2 | 2/2009 | Hershkowitz et al. |
| 7,492,054 | B2 | 2/2009 | Catlin |
| 7,493,769 | B2 | 2/2009 | Jangili |
| 7,498,009 | B2 | 3/2009 | Leach et al. |
| 7,503,178 | B2 | 3/2009 | Bucker et al. |
| 7,503,948 | B2 | 3/2009 | Hershkowitz et al. |
| 7,506,501 | B2 | 3/2009 | Anderson et al. |
| 7,513,099 | B2 | 4/2009 | Nuding et al. |
| 7,513,100 | B2 | 4/2009 | Motter et al. |
| 7,516,626 | B2 | 4/2009 | Brox et al. |
| 7,520,134 | B2 | 4/2009 | Durbin et al. |
| 7,520,724 | B2 | 4/2009 | Naik et al. |
| 7,523,603 | B2 | 4/2009 | Hagen et al. |
| 7,536,252 | B1 | 5/2009 | Hibshman et al. |
| 7,536,873 | B2 | 5/2009 | Nohlen |
| 7,540,150 | B2 | 6/2009 | Schmid et al. |
| 7,559,977 | B2 | 7/2009 | Fleischer et al. |
| 7,562,519 | B1 | 7/2009 | Harris et al. |
| 7,562,529 | B2 | 7/2009 | Kuspert et al. |
| 7,566,394 | B2 | 7/2009 | Koseoglu |
| 7,574,856 | B2 | 8/2009 | Mak |
| 7,591,866 | B2 | 9/2009 | Bose |
| 7,594,386 | B2 | 9/2009 | Narayanan et al. |
| 7,610,752 | B2 | 11/2009 | Betta et al. |
| 7,610,759 | B2 | 11/2009 | Yoshida et al. |
| 7,611,681 | B2 | 11/2009 | Kaefer |
| 7,614,352 | B2 | 11/2009 | Anthony et al. |
| 7,618,606 | B2 | 11/2009 | Fan et al. |
| 7,631,493 | B2 | 12/2009 | Shirakawa et al. |
| 7,634,915 | B2 | 12/2009 | Hoffmann et al. |
| 7,635,408 | B2 | 12/2009 | Mak et al. |
| 7,637,093 | B2 | 12/2009 | Rao |
| 7,644,573 | B2 | 1/2010 | Smith et al. |
| 7,650,744 | B2 | 1/2010 | Varatharajan et al. |
| 7,654,320 | B2 | 2/2010 | Payton |
| 7,654,330 | B2 | 2/2010 | Zubrin et al. |
| 7,655,071 | B2 | 2/2010 | De Vreede |
| 7,670,135 | B1 | 3/2010 | Zink et al. |
| 7,673,454 | B2 | 3/2010 | Saito et al. |
| 7,673,685 | B2 | 3/2010 | Shaw et al. |
| 7,674,443 | B1 | 3/2010 | Davis |
| 7,677,309 | B2 | 3/2010 | Shaw et al. |
| 7,681,394 | B2 | 3/2010 | Haugen |
| 7,682,426 | B2 | 3/2010 | Burtscher et al. |
| 7,682,597 | B2 | 3/2010 | Blumenfeld et al. |
| 7,690,204 | B2 | 4/2010 | Drnevich et al. |
| 7,691,788 | B2 | 4/2010 | Tan et al. |
| 7,695,703 | B2 | 4/2010 | Sobolevskiy et al. |
| 7,698,898 | B2 | 4/2010 | Eluripati et al. |
| 7,717,173 | B2 | 5/2010 | Grott |
| 7,721,543 | B2 | 5/2010 | Massey et al. |
| 7,726,114 | B2 | 6/2010 | Evulet |
| 7,734,408 | B2 | 6/2010 | Shiraki |
| 7,739,864 | B2 | 6/2010 | Finkenrath et al. |
| 7,749,311 | B2 | 7/2010 | Saito et al. |
| 7,752,848 | B2 | 7/2010 | Balan et al. |
| 7,752,850 | B2 | 7/2010 | Laster et al. |
| 7,753,039 | B2 | 7/2010 | Harima et al. |
| 7,753,972 | B2 | 7/2010 | Zubrin et al. |
| 7,762,084 | B2 | 7/2010 | Martis et al. |
| 7,763,163 | B2 | 7/2010 | Koseoglu |
| 7,763,227 | B2 | 7/2010 | Wang |
| 7,765,810 | B2 | 8/2010 | Pfefferle |
| 7,788,897 | B2 | 9/2010 | Campbell et al. |
| 7,789,159 | B1 | 9/2010 | Bader |
| 7,789,658 | B2 | 9/2010 | Towler et al. |
| 7,789,944 | B2 | 9/2010 | Saito et al. |
| 7,793,494 | B2 | 9/2010 | Wirth et al. |
| 7,802,434 | B2 | 9/2010 | Varatharajan et al. |
| 7,815,873 | B2 | 10/2010 | Sankaranarayanan et al. |
| 7,815,892 | B2 | 10/2010 | Hershkowitz et al. |
| 7,819,951 | B2 | 10/2010 | White et al. |
| 7,823,390 | B2 | 11/2010 | Eluripati et al. |
| 7,824,179 | B2 | 11/2010 | Hasegawa et al. |
| 7,827,778 | B2 | 11/2010 | Finkenrath et al. |
| 7,827,794 | B1 | 11/2010 | Pronske et al. |
| 7,841,186 | B2 | 11/2010 | So et al. |
| 7,845,406 | B2 | 12/2010 | Nitschke |
| 7,846,401 | B2 | 12/2010 | Hershkowitz et al. |
| 7,861,511 | B2 | 1/2011 | Chillar et al. |
| 7,874,140 | B2 | 1/2011 | Fan et al. |
| 7,874,350 | B2 | 1/2011 | Pfefferle |
| 7,875,402 | B2 | 1/2011 | Hershkowitz et al. |
| 7,882,692 | B2 | 2/2011 | Pronske et al. |
| 7,886,522 | B2 | 2/2011 | Kammel |
| 7,895,822 | B2 | 3/2011 | Hoffmann et al. |
| 7,896,105 | B2 | 3/2011 | Dupriest |
| 7,906,304 | B2 | 3/2011 | Kohr |
| 7,909,898 | B2 | 3/2011 | White et al. |
| 7,914,749 | B2 | 3/2011 | Carstens et al. |
| 7,914,764 | B2 | 3/2011 | Hershkowitz et al. |

(56) References Cited

U.S. PATENT DOCUMENTS 7,918,906 B2 4/2011 Zubrin et al.
7,921,633 B2 4/2011 Rising
7,922,871 B2 4/2011 Price et al.
7,926,292 B2 4/2011 Rabovitser et al.
7,931,712 B2 4/2011 Zubrin et al.
7,931,731 B2 4/2011 Van Heeringen et al.
7,931,888 B2 4/2011 Drnevich et al.
7,934,926 B2 5/2011 Kornbluth et al.
7,942,003 B2 5/2011 Baudoin et al.
7,942,008 B2 5/2011 Joshi et al.
7,943,097 B2 5/2011 Golden et al.
7,955,403 B2 6/2011 Ariyapadi et al.
7,966,822 B2 6/2011 Myers et al.
7,976,803 B2 7/2011 Hooper et al.
7,980,312 B1 7/2011 Hill et al.
7,985,399 B2 7/2011 Drnevich et al.
7,988,750 B2 8/2011 Lee et al.
8,001,789 B2 8/2011 Vega et al.
8,029,273 B2 10/2011 Paschereit et al.
8,036,813 B2 10/2011 Tonetti et al.
8,038,416 B2 10/2011 Ono et al.
8,038,746 B2 10/2011 Clark
8,038,773 B2 10/2011 Ochs et al.
8,046,986 B2 11/2011 Chillar et al.
8,047,007 B2 11/2011 Zubrin et al.
8,051,638 B2 11/2011 Aljabari et al.
8,061,120 B2 11/2011 Hwang
8,062,617 B2 11/2011 Stakhev et al.
8,065,870 B2 11/2011 Jobson et al.
8,065,874 B2 11/2011 Fong et al.
8,074,439 B2 12/2011 Foret
8,080,225 B2 12/2011 Dickinson et al.
8,083,474 B2 12/2011 Hashimoto et al.
8,096,747 B2 1/2012 Sengar et al.
8,097,230 B2 1/2012 Mesters et al.
8,101,146 B2 1/2012 Fedeyko et al.
8,105,559 B2 1/2012 Melville et al.
8,110,012 B2 2/2012 Chiu et al.
8,117,825 B2 2/2012 Griffin et al.
8,117,846 B2 2/2012 Wilbraham
8,127,558 B2 3/2012 Bland et al.
8,127,936 B2 3/2012 Liu et al.
8,127,937 B2 3/2012 Liu et al.
8,133,298 B2 3/2012 Lanyi et al.
8,142,169 B2 3/2012 Whaling et al.
8,166,766 B2 5/2012 Draper
8,167,960 B2 5/2012 Gil
8,176,982 B2 5/2012 Gil et al.
8,191,360 B2 6/2012 Fong et al.
8,191,361 B2 6/2012 Fong et al.
8,196,387 B2 6/2012 Shah et al.
8,196,413 B2 6/2012 Mak
8,201,402 B2 6/2012 Fong et al.
8,205,455 B2 6/2012 Popovic
8,206,669 B2 6/2012 Schaffer et al.
8,209,192 B2 6/2012 Gil et al.
8,215,105 B2 7/2012 Fong et al.
8,220,247 B2 7/2012 Wijmans et al.
8,220,248 B2 7/2012 Wijmans et al.
8,220,268 B2 7/2012 Callas
8,225,600 B2 7/2012 Theis
8,226,912 B2 7/2012 Kloosterman et al.
8,240,142 B2 8/2012 Fong et al.
8,240,153 B2 8/2012 Childers et al.
8,241,813 B2 8/2012 Townsend et al.
8,245,492 B2 8/2012 Draper
8,245,493 B2 8/2012 Minto
8,247,462 B2 8/2012 Boshoff et al.
8,257,476 B2 9/2012 White et al.
8,261,823 B1 9/2012 Hill et al.
8,262,343 B2 9/2012 Hagen
8,266,883 B2 9/2012 Ouellet et al.
8,266,913 B2 9/2012 Snook et al.
8,268,044 B2 9/2012 Wright et al.
8,281,596 B1 10/2012 Rohrssen et al.
8,316,665 B2 11/2012 Mak
8,316,784 B2 11/2012 D'Agostini
8,337,613 B2 12/2012 Zauderer
8,347,600 B2 1/2013 Wichmann et al.
8,348,551 B2 1/2013 Baker et al.
8,371,100 B2 2/2013 Draper
8,372,251 B2 2/2013 Goller et al.
8,377,184 B2 2/2013 Fujikawa et al.
8,377,401 B2 2/2013 Darde et al.
8,388,919 B2 3/2013 Hooper et al.
8,397,482 B2 3/2013 Kraemer et al.
8,398,757 B2 3/2013 Iijima et al.
8,409,307 B2 4/2013 Drnevich et al.
8,414,694 B2 4/2013 Iijima et al.
8,424,282 B2 4/2013 Vollmer et al.
8,424,601 B2 4/2013 Betzer-Zilevitch
8,436,489 B2 5/2013 Stahlkopf et al.
8,453,461 B2 6/2013 Draper
8,453,462 B2 6/2013 Wichmann et al.
8,453,583 B2 6/2013 Malavasi et al.
8,454,350 B2 6/2013 Berry et al.
8,475,160 B2 7/2013 Campbell et al.
8,539,749 B1 9/2013 Wichmann et al.
8,567,200 B2 10/2013 Brook et al.
8,616,294 B2 12/2013 Zubrin et al.
8,627,643 B2 1/2014 Chillar et al.
2001/0000049 A1 3/2001 Kataoka et al.
2001/0029732 A1 10/2001 Bachmann
2001/0045090 A1 11/2001 Gray
2002/0043063 A1 4/2002 Kataoka et al.
2002/0053207 A1 5/2002 Finger et al.
2002/0069648 A1 6/2002 Levy et al.
2002/0106001 A1* 8/2002 Tomlinson ..... F02C 9/28
374/144
2002/0187449 A1 12/2002 Doebbeling et al.
2003/0005698 A1 1/2003 Keller
2003/0046938 A1 3/2003 Mortzheim et al.
2003/0131582 A1 7/2003 Anderson et al.
2003/0134241 A1 7/2003 Marin et al.
2003/0221409 A1 12/2003 McGowan
2004/0006994 A1 1/2004 Walsh et al.
2004/0007013 A1 1/2004 Takeuchi
2004/0068981 A1 4/2004 Siefker et al.
2004/0166034 A1 8/2004 Kaefer
2004/0170559 A1 9/2004 Hershkowitz et al.
2004/0202578 A1 10/2004 Burtscher et al.
2004/0223408 A1 11/2004 Mathys et al.
2004/0238654 A1 12/2004 Hagen et al.
2005/0028529 A1 2/2005 Bartlett et al.
2005/0092263 A1 5/2005 Engdahl
2005/0103323 A1 5/2005 Engdahl
2005/0144961 A1 7/2005 Colibaba-Evulet et al.
2005/0197267 A1 9/2005 Zaki et al.
2005/0229585 A1 10/2005 Webster
2005/0236602 A1 10/2005 Viteri et al.
2005/0257828 A1 11/2005 Arno et al.
2006/0112675 A1 6/2006 Anderson et al.
2006/0158961 A1 7/2006 Ruscheweyh et al.
2006/0183009 A1 8/2006 Berlowitz et al.
2006/0196812 A1 9/2006 Beetge et al.
2006/0248888 A1 11/2006 Geskes
2006/0292006 A1 12/2006 Naik et al.
2007/0000242 A1 1/2007 Harmon et al.
2007/0006728 A1 1/2007 Burtscher et al.
2007/0044475 A1 3/2007 Leser et al.
2007/0044479 A1 3/2007 Brandt et al.
2007/0089425 A1 4/2007 Motter et al.
2007/0107430 A1 5/2007 Schmid et al.
2007/0144747 A1 6/2007 Steinberg
2007/0231233 A1 10/2007 Bose
2007/0234702 A1 10/2007 Hagen et al.
2007/0245736 A1 10/2007 Barnicki
2007/0249738 A1 10/2007 Haynes et al.
2007/0272201 A1 11/2007 Amano et al.
2008/0000229 A1 1/2008 Kuspert et al.
2008/0006561 A1 1/2008 Moran et al.
2008/0010967 A1 1/2008 Griffin et al.
2008/0034727 A1 2/2008 Sutikno
2008/0038598 A1 2/2008 Berlowitz et al.

(56) References Cited

U.S. PATENT DOCUMENTS

| | | | |
|---|---|---|---|
| 2008/0047280 | A1 | 2/2008 | Dubar |
| 2008/0066443 | A1 | 3/2008 | Frutschi et al. |
| 2008/0115478 | A1 | 5/2008 | Sullivan |
| 2008/0118310 | A1 | 5/2008 | Graham |
| 2008/0127632 | A1 | 6/2008 | Finkenrath et al. |
| 2008/0155984 | A1 | 7/2008 | Liu et al. |
| 2008/0178611 | A1 | 7/2008 | Ding |
| 2008/0202092 | A1 | 8/2008 | Eluripati et al. |
| 2008/0202123 | A1 | 8/2008 | Sullivan et al. |
| 2008/0223038 | A1 | 9/2008 | Lutz et al. |
| 2008/0250795 | A1 | 10/2008 | Katdare et al. |
| 2008/0251234 | A1 | 10/2008 | Wilson et al. |
| 2008/0290719 | A1 | 11/2008 | Kaminsky et al. |
| 2008/0309087 | A1 | 12/2008 | Evulet et al. |
| 2009/0000762 | A1 | 1/2009 | Wilson et al. |
| 2009/0020411 | A1 | 1/2009 | Holunga et al. |
| 2009/0025390 | A1 | 1/2009 | Christensen et al. |
| 2009/0038247 | A1 | 2/2009 | Taylor et al. |
| 2009/0042082 | A1 | 2/2009 | Townsend et al. |
| 2009/0056342 | A1 | 3/2009 | Kirzhner |
| 2009/0064653 | A1 | 3/2009 | Hagen et al. |
| 2009/0067988 | A1 | 3/2009 | Eluripati et al. |
| 2009/0071166 | A1 | 3/2009 | Hagen et al. |
| 2009/0107141 | A1 | 4/2009 | Chillar et al. |
| 2009/0117024 | A1 | 5/2009 | Weedon et al. |
| 2009/0120087 | A1 | 5/2009 | Sumser et al. |
| 2009/0157230 | A1 | 6/2009 | Hibshman et al. |
| 2009/0193809 | A1 | 8/2009 | Schroder et al. |
| 2009/0196736 | A1 | 8/2009 | Sengar et al. |
| 2009/0205334 | A1 | 8/2009 | Aljabari et al. |
| 2009/0218821 | A1 | 9/2009 | ElKady et al. |
| 2009/0223227 | A1 | 9/2009 | Lipinski et al. |
| 2009/0229263 | A1 | 9/2009 | Ouellet et al. |
| 2009/0235637 | A1 | 9/2009 | Foret |
| 2009/0241506 | A1 | 10/2009 | Nilsson |
| 2009/0255242 | A1 | 10/2009 | Paterson et al. |
| 2009/0262599 | A1 | 10/2009 | Kohrs et al. |
| 2009/0284013 | A1 | 11/2009 | Anand et al. |
| 2009/0301054 | A1 | 12/2009 | Simpson et al. |
| 2009/0301099 | A1 | 12/2009 | Nigro |
| 2010/0003123 | A1 | 1/2010 | Smith |
| 2010/0018218 | A1 | 1/2010 | Riley et al. |
| 2010/0058732 | A1 | 3/2010 | Kaufmann et al. |
| 2010/0115960 | A1 | 5/2010 | Brautsch et al. |
| 2010/0126176 | A1 | 5/2010 | Kim |
| 2010/0126906 | A1 | 5/2010 | Sury |
| 2010/0162703 | A1 | 7/2010 | Li et al. |
| 2010/0170253 | A1 | 7/2010 | Berry et al. |
| 2010/0180565 | A1 | 7/2010 | Draper |
| 2010/0300102 | A1 | 12/2010 | Bathina et al. |
| 2010/0310439 | A1 | 12/2010 | Brok et al. |
| 2010/0322759 | A1 | 12/2010 | Tanioka |
| 2010/0326084 | A1 | 12/2010 | Anderson et al. |
| 2011/0000221 | A1 | 1/2011 | Minta et al. |
| 2011/0000671 | A1 | 1/2011 | Hershkowitz et al. |
| 2011/0036082 | A1 | 2/2011 | Collinot |
| 2011/0048002 | A1 | 3/2011 | Taylor et al. |
| 2011/0048010 | A1 | 3/2011 | Balcezak et al. |
| 2011/0072779 | A1 | 3/2011 | ELKady et al. |
| 2011/0088379 | A1 | 4/2011 | Nanda |
| 2011/0110759 | A1 | 5/2011 | Sanchez et al. |
| 2011/0126512 | A1 | 6/2011 | Anderson |
| 2011/0138766 | A1 | 6/2011 | ELKady et al. |
| 2011/0162353 | A1 | 7/2011 | Vanvolsem et al. |
| 2011/0205837 | A1 | 8/2011 | Gentgen |
| 2011/0226010 | A1 | 9/2011 | Baxter |
| 2011/0227346 | A1 | 9/2011 | Klenven |
| 2011/0232545 | A1 | 9/2011 | Clements |
| 2011/0239653 | A1 | 10/2011 | Valeev et al. |
| 2011/0265447 | A1 | 11/2011 | Cunningham |
| 2011/0268563 | A1 | 11/2011 | Stretton |
| 2011/0300493 | A1 | 12/2011 | Mittricker et al. |
| 2012/0023954 | A1 | 2/2012 | Wichmann |
| 2012/0023955 | A1 | 2/2012 | Draper |
| 2012/0023956 | A1 | 2/2012 | Popovic |
| 2012/0023957 | A1 | 2/2012 | Draper et al. |
| 2012/0023958 | A1 | 2/2012 | Snook et al. |
| 2012/0023960 | A1 | 2/2012 | Minto |
| 2012/0023962 | A1 | 2/2012 | Wichmann et al. |
| 2012/0023963 | A1 | 2/2012 | Wichmann et al. |
| 2012/0023966 | A1 | 2/2012 | Ouellet et al. |
| 2012/0031581 | A1 | 2/2012 | Chillar et al. |
| 2012/0032810 | A1 | 2/2012 | Chillar et al. |
| 2012/0085100 | A1 | 4/2012 | Hughes et al. |
| 2012/0096870 | A1 | 4/2012 | Wichmann et al. |
| 2012/0119512 | A1 | 5/2012 | Draper |
| 2012/0131925 | A1 | 5/2012 | Mittricker et al. |
| 2012/0144837 | A1 | 6/2012 | Rasmussen et al. |
| 2012/0185144 | A1 | 7/2012 | Draper |
| 2012/0192565 | A1 | 8/2012 | Tretyakov et al. |
| 2012/0247105 | A1 | 10/2012 | Nelson et al. |
| 2012/0260660 | A1 | 10/2012 | Kraemer et al. |
| 2013/0086916 | A1 | 4/2013 | Oelfke et al. |
| 2013/0086917 | A1 | 4/2013 | Slobodyanskiy et al. |
| 2013/0091853 | A1 | 4/2013 | Denton et al. |
| 2013/0091854 | A1 | 4/2013 | Gupta et al. |
| 2013/0104562 | A1 | 5/2013 | Oelfke et al. |
| 2013/0104563 | A1 | 5/2013 | Oelfke et al. |
| 2013/0111944 | A1 | 5/2013 | Wang et al. |
| 2013/0125554 | A1 | 5/2013 | Mittricker et al. |
| 2013/0125555 | A1 | 5/2013 | Mittricker et al. |
| 2013/0232980 | A1 | 9/2013 | Chen et al. |
| 2013/0269310 | A1 | 10/2013 | Wichmann et al. |
| 2013/0269311 | A1 | 10/2013 | Wichmann et al. |
| 2013/0269355 | A1 | 10/2013 | Wichmann et al. |
| 2013/0269356 | A1 | 10/2013 | Butkiewicz et al. |
| 2013/0269357 | A1 | 10/2013 | Wichmann et al. |
| 2013/0269358 | A1 | 10/2013 | Wichmann et al. |
| 2013/0269360 | A1 | 10/2013 | Wichmann et al. |
| 2013/0269361 | A1 | 10/2013 | Wichmann et al. |
| 2013/0269362 | A1 | 10/2013 | Wichmann et al. |
| 2013/0283808 | A1 | 10/2013 | Kolvick |
| 2014/0000271 | A1 | 1/2014 | Mittricker et al. |
| 2014/0000273 | A1 | 1/2014 | Mittricker et al. |
| 2014/0007590 | A1 | 1/2014 | Huntington et al. |
| 2014/0013766 | A1 | 1/2014 | Mittricker et al. |
| 2014/0020398 | A1 | 1/2014 | Mittricker et al. |
| 2014/0060073 | A1 | 3/2014 | Slobodyanskiy et al. |
| 2014/0123620 | A1 | 5/2014 | Huntington et al. |
| 2014/0123624 | A1 | 5/2014 | Minto |
| 2014/0123659 | A1 | 5/2014 | Biyani et al. |
| 2014/0123660 | A1 | 5/2014 | Stoia et al. |
| 2014/0123668 | A1 | 5/2014 | Huntington et al. |
| 2014/0123669 | A1 | 5/2014 | Huntington et al. |
| 2014/0123672 | A1 | 5/2014 | Huntington et al. |
| 2014/0150445 | A1 | 6/2014 | Huntington et al. |
| 2014/0182298 | A1 | 7/2014 | Krull et al. |
| 2014/0182299 | A1 | 7/2014 | Woodall et al. |
| 2014/0182301 | A1 | 7/2014 | Angelyn et al. |
| 2014/0182302 | A1 | 7/2014 | Angelyn et al. |
| 2014/0182303 | A1 | 7/2014 | Angelyn et al. |
| 2014/0182304 | A1 | 7/2014 | Angelyn et al. |
| 2014/0182305 | A1 | 7/2014 | Angelyn et al. |
| 2014/0196464 | A1 | 7/2014 | Biyani et al. |
| 2014/0216011 | A1 | 8/2014 | Muthaiah et al. |
| 2015/0000292 | A1 | 1/2015 | Subramaniyan |
| 2015/0000293 | A1 | 1/2015 | Thatcher et al. |
| 2015/0000294 | A1 | 1/2015 | Minto et al. |
| 2015/0000299 | A1 | 1/2015 | Zuo et al. |
| 2015/0033748 | A1 | 2/2015 | Vaezi |
| 2015/0033749 | A1 | 2/2015 | Slobodyanskiy et al. |
| 2015/0033751 | A1 | 2/2015 | Andrew |
| 2015/0033757 | A1 | 2/2015 | White et al. |
| 2015/0040574 | A1 | 2/2015 | Wichmann et al. |
| 2015/0059350 | A1 | 3/2015 | Kolvick et al. |
| 2015/0075171 | A1 | 3/2015 | Sokolov et al. |
| 2015/0152791 | A1 | 6/2015 | White |
| 2015/0198089 | A1 | 7/2015 | Muthaiah et al. |
| 2015/0204239 | A1 | 7/2015 | Minto et al. |
| 2015/0214879 | A1 | 7/2015 | Huntington et al. |
| 2015/0226133 | A1 | 8/2015 | Minto et al. |
| 2015/0308293 | A1 | 10/2015 | Huntington et al. |
| 2015/0330252 | A1 | 11/2015 | Manchikanti et al. |

(56) References Cited

U.S. PATENT DOCUMENTS

| | | | |
|---|---|---|---|
| 2015/0377140 | A1 | 12/2015 | Rittenhouse et al. |
| 2015/0377146 | A1 | 12/2015 | Della-Fera et al. |
| 2015/0377148 | A1 | 12/2015 | Minto et al. |

FOREIGN PATENT DOCUMENTS

| | | |
|---|---|---|
| EP | 0316688 | 9/1992 |
| EP | 0626036 | 10/1996 |
| EP | 0770771 | 5/1997 |
| EP | 1980717 | 10/2008 |
| EP | 2354492 | 8/2011 |
| EP | 2383441 | 11/2011 |
| EP | 1965052 | 8/2012 |
| GB | 0776269 | 6/1957 |
| GB | 2117053 | 10/1983 |
| WO | WO1999006674 | 2/1999 |
| WO | WO1999063210 | 12/1999 |
| WO | WO2007068682 | 6/2007 |
| WO | WO2008142009 | 11/2008 |
| WO | WO2011003606 | 1/2011 |
| WO | WO2012003489 | 1/2012 |
| WO | WO2012128928 | 9/2012 |
| WO | WO2012128929 | 9/2012 |
| WO | WO2012170114 | 12/2012 |
| WO | WO2013147632 | 10/2013 |
| WO | WO2013147633 | 10/2013 |
| WO | WO2013155214 | 10/2013 |
| WO | WO2013163045 | 10/2013 |
| WO | WO2014071118 | 5/2014 |
| WO | WO2014071215 | 5/2014 |
| WO | WO2014133406 | 9/2014 |

OTHER PUBLICATIONS

U.S. Appl. No. 14/771,450, filed Feb. 28, 2013, Valeev et al.
U.S. Appl. No. 14/599,750, filed Jan. 19, 2015, O'Dea et al.
Ahmed, S. et al. (1998) "Catalytic Partial Oxidation Reforming of Hydrocarbon Fuels," 1998 Fuel Cell Seminar, 7 pgs.
Air Products and Chemicals, Inc. (2008) "Air Separation Technology—Ion Transport Membrane (ITM)," www.airproducts.com/ASUsales, 3 pgs.
Air Products and Chemicals, Inc. (2011) "Air Separation Technology Ion Transport Membrane (ITM)," www.airproducts.com/gasification, 4 pgs.
Anderson, R. E. (2006) "Durability and Reliability Demonstration of a Near-Zero-Emission Gas-Fired Power Plant," California Energy Comm., CEC 500-2006-074, 80 pgs.
Baxter, E. et al. (2003) "Fabricate and Test an Advanced Non-Polluting Turbine Drive Gas Generator," U. S. Dept. of Energy, Nat'l Energy Tech. Lab., DE-FC26-00NT 40804, 51 pgs.
Bolland, O. et al. (1998) "Removal of CO2 From Gas Turbine Power Plants Evaluation of Pre- and Postcombustion Methods," SINTEF Group, www.energy.sintef.no/publ/xergi/98/3/art-8engelsk.htm, 11 pgs.
BP Press Release (2006) "BP and Edison Mission Group Plan Major Hydrogen Power Project for California," www.bp.com/hydrogenpower, 2 pgs.
Bryngelsson, M. et al. (2005) "Feasibility Study of $CO_2$ Removal From Pressurized Flue Gas in a Fully Fired Combined Cycle—The Sargas Project," KTH—Royal Institute of Technology, Dept. of Chemical Engineering and Technology, 9 pgs.
Clark, Hal (2002) "Development of a Unique Gas Generator for a Non-Polluting Power Plant," California Energy Commission Feasibility Analysis, P500-02-011F, 42 pgs.
Foy, Kirsten et al. (2005) "Comparison of Ion Transport Membranes" Fourth Annual Conference on Carbon Capture and Sequestration, DOE/NETL; 11 pgs.
Cho, J. H. et al. (2005) "Marrying LNG and Power Generation," Energy Markets; 10, 8; ABI/INFORM Trade & Industry, 5 pgs.
Ciulia, Vincent. (2001-2003) "Auto Repair. How the Engine Works," http://autorepair.about.com/cs/generalinfo/a/aa060500a.htm, 1 page.
Corti, A. et al. (1988) "Athabasca Mineable Oil Sands: The RTR/Gulf Extraction Process Theoretical Model of Bitumen Detachment," $4^{th}$ UNITAR/UNDP Int'l Conf. on Heavy Crude and Tar Sands Proceedings, v.5, paper No. 81, Edmonton, AB, Canada, 4 pgs.
Science Clarified (2012) "Cryogenics," http://www.scienceclarified.com/Co-Di/Cryogenics.html; 6 pgs.
Defrate, L. A. et al. (1959) "Optimum Design of Ejector Using Digital Computers" Chem. Eng. Prog. Symp. Ser., 55 ( 21), 12 pgs.
Ditaranto, M. et al. (2006) "Combustion Instabilities in Sudden Expansion Oxy-Fuel Flames," ScienceDirect, Combustion and Flame, v.146, 20 pgs.
Elwell, L. C. et al. (2005) "Technical Overview of Carbon Dioxide Capture Technologies for Coal-Fired Power Plants," MPR Associates, Inc., www.mpr.com/uploads/news/co2-capture-coal-fired.pdf, 15 pgs.
Eriksson, Sara. (2005) "Development of Methane Oxidation Catalysts for Different Gas Turbine Combustor Concepts." KTH—The Royal Institute of Technology, Department of Chemical Engineering and Technology, Chemical Technology, Licentiate Thesis, Stockholm Sweden; 45 pgs.
Ertesvag, I. S. et al. (2005) "Exergy Analysis of a Gas-Turbine Combined-Cycle Power Plant With Precombustion $CO_2$ Capture," Elsevier, 35 pgs.
Elkady, Ahmed. M. et al. (2009) "Application of Exhaust Gas Recirculation in a DLN F-Class Combustion System for Postcombustion Carbon Capture," ASME J. Engineering for Gas Turbines and Power, vol. 131, 6 pgs.
Evulet, Andrei T. et al. (2009) "On the Performance and Operability of GE's Dry Low $NO_x$ Combustors utilizing Exhaust Gas Recirculation for Post-Combustion Carbon Capture" Energy. Procedia I, 8 pgs.
Caldwell Energy Company (2011) "Wet Compression"; IGTI 2011—CTIC Wet Compression, http://www.turbineinletcooling.org/resources/papers/CTIC_WetCompression_Shepherd_ASMETurboExpo2011.pdf , 22 pgs.
Luby, P. et al. (2003) "Zero Carbon Power Generation: IGCC as the Premium Option," Powergen International, 19 pgs.
Macadam, S. et al. (2007) "Coal-Based Oxy-Fuel System Evaluation and Combustor Development," Clean Energy Systems, Inc.; presented at the $2^{nd}$ International Freiberg Conference on IGCC & XtL Technologies, 6 pgs.
Morehead, H. (2007) "Siemens Global Gasification and IGCC Update," Siemens, Coal-Gen, 17 pgs.
Nanda, R. et al. (2007) "Utilizing Air Based Technologies as Heat Source for LNG Vaporization," presented at the $86^{th}$ Annual convention of the Gas Processors of America (GPA 2007), San Antonio, TX; 13 pgs.
Reeves, S. R. (2001) "Geological Sequestration of $CO_2$ in Deep, Unmineable Coalbeds: An Integrated Research and Commercial-Scale Field Demonstration Project," SPE 71749; presented at the 2001 SPE Annual Technical Conference and Exhibition, New Orleans, Louisiana, 10 pgs.
Reeves, S. R. (2003) "Enhanced Coalbed Methane Recovery," Society of Petroleum Engineers 101466-DL; SPE Distinguished Lecture Series, 8 pgs.
Richards, Geo A., et al. (2001) "Advanced Steam Generators," National Energy Technology Lab., Pittsburgh, PA, and Morgantown, WV; NASA Glenn Research Center (US), 7 pgs.
Rosetta, M. J. et al. (2006) "Integrating Ambient Air Vaporization Technology with Waste Heat Recovery—A Fresh Approach to LNG Vaporization," presented at the $85^{th}$ annual convention of the Gas Processors of America (GPA 2006), Grapevine, Texas, 22 pgs.
Snarheim, D. et al. (2006) "Control Design for a Gas Turbine Cycle With $CO_2$ Capture Capabilities," Modeling, Identification and Control, vol. 00; presented at the $16^{th}$ IFAC World Congress, Prague, Czech Republic, 10 pgs.
Ulfsnes, R. E. et al. (2003) "Investigation of Physical Properties for $CO_2/H_2O$ Mixtures for use in Semi-Closed $O_2/CO_2$ Gas Turbine Cycle With $CO_2$-Capture," Department of Energy and Process Eng., Norwegian Univ. of Science and Technology, 9 pgs.

(56) References Cited

OTHER PUBLICATIONS

Van Hemert, P. et al. (2006) "Adsorption of Carbon Dioxide and a Hydrogen-Carbon Dioxide Mixture," Intn'l Coalbed Methane Symposium (Tuscaloosa, AL) Paper 0615, 9 pgs.
Zhu, J. et al. (2002) "Recovery of Coalbed Methane by Gas Injection," Society of Petroleum Engineers 75255; presented at the 2002 SPE Annual Technical Conference and Exhibition, Tulsa, Oklahoma, 15 pgs.

* cited by examiner

SYSTEM AND METHOD FOR COOLING DISCHARGE FLOW

CROSS-REFERENCE TO RELATED APPLICATION

This application is a continuation of U.S. patent application Ser. No. 15/060,089, entitled "SYSTEM AND METHOD FOR COOLING DISCHARGE FLOW," filed Mar. 3, 2016, which claims priority to and benefit of U.S. Provisional Patent Application No. 62/128,337, entitled "SYSTEM AND METHOD FOR COOLING DISCHARGE FLOW," filed on Mar. 4, 2015, which are incorporated by reference herein in their entirety for all purposes.

BACKGROUND

The subject matter disclosed herein relates to probes, and more specifically, to control of discharge flows from probes coupled to gas turbine engines.

A gas turbine engine combusts a mixture of fuel and oxidant to generate hot exhaust gases, which in turn drive one or more turbine stages. Probes, such as temperature probes, pressure probes, and lambda probes, may be coupled to various components of the gas turbine engine that may operate in a high temperature environment. Unfortunately, the probes may be subjected to high temperatures. Therefore, a need exists for cooling of the probes with minimal impact to the surrounding environment.

BRIEF DESCRIPTION

Certain embodiments commensurate in scope with the present disclosure are summarized below. These embodiments are not intended to limit the scope of the claims, but rather these embodiments are intended only to provide a brief summary of possible forms of the present disclosure. Indeed, embodiments of the present disclosure may encompass a variety of forms that may be similar to or different from the embodiments set forth below.

In a first embodiment, a system includes a probe. The probe includes a sensing component configured to sense a parameter of a turbomachine. The probe also includes an inlet configured to receive a cooling inflow. The probe also includes a cooling passage configured to receive the cooling inflow from the inlet. The cooling passage is disposed along at least a portion of the probe, and the cooling inflow absorbs heat from the probe. The probe also includes an outlet coupled to the cooling passage and configured to receive an outflow from the cooling passage. The outflow includes at least a portion of the cooling inflow. The system also includes an ejector coupled to the outlet. The ejector includes an interior. The ejector also includes an opening fluidly coupled to the interior. The opening is configured to receive a coolant. The ejector also includes a nozzle coupled to the outlet. The nozzle is configured to constrict the outflow from the outlet and to deliver the outflow to the interior. The ejector also includes a mixing portion configured to mix the outflow and the coolant to provide a discharge flow.

In a second embodiment, a system includes a probe. The probe includes a sensing component configured to sense a parameter of a gas turbine engine. The probe also includes an inlet configured to receive a cooling inflow. The probe also includes a cooling passage configured to receive the cooling inflow from the inlet. The cooling passage is disposed along at least a portion of the probe, and the cooling inflow absorbs heat from the probe to form a heated outflow. The probe also includes an outlet coupled to the cooling passage and configured to receive the heated outflow from the cooling passage. A temperature of the heated outflow at the outlet is greater than 80° C. The system also includes an ejector coupled to the outlet. The ejector includes an interior. The ejector also includes an opening fluidly coupled to the interior. The opening is configured to receive a coolant. The ejector also includes a nozzle coupled to the outlet. The nozzle is configured to constrict the heated outflow from the outlet and to deliver the heated outflow to the interior. The ejector also includes a mixing portion configured to mix the heated outflow and the coolant to provide a discharge flow. A temperature of the discharge flow is less than 80° C.

In a third embodiment, a method includes supplying a cooling inflow to a probe configured to sense a parameter of a gas turbine engine. The cooling inflow is configured to absorb heat from the probe to form a heated outflow. The method also includes directing the heated outflow from the probe to an ejector. The ejector includes a nozzle coupled to an outlet of the probe. The method also includes constricting the heated outflow through the nozzle into an interior of the ejector to draw a coolant into the interior of the ejector via an opening. The method also includes mixing the heated outflow and the coolant to form a discharge flow in a mixing portion of the ejector. The method also includes directing the discharge flow to an ejector outlet of the ejector. A temperature of the discharge flow is less than 80° C.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
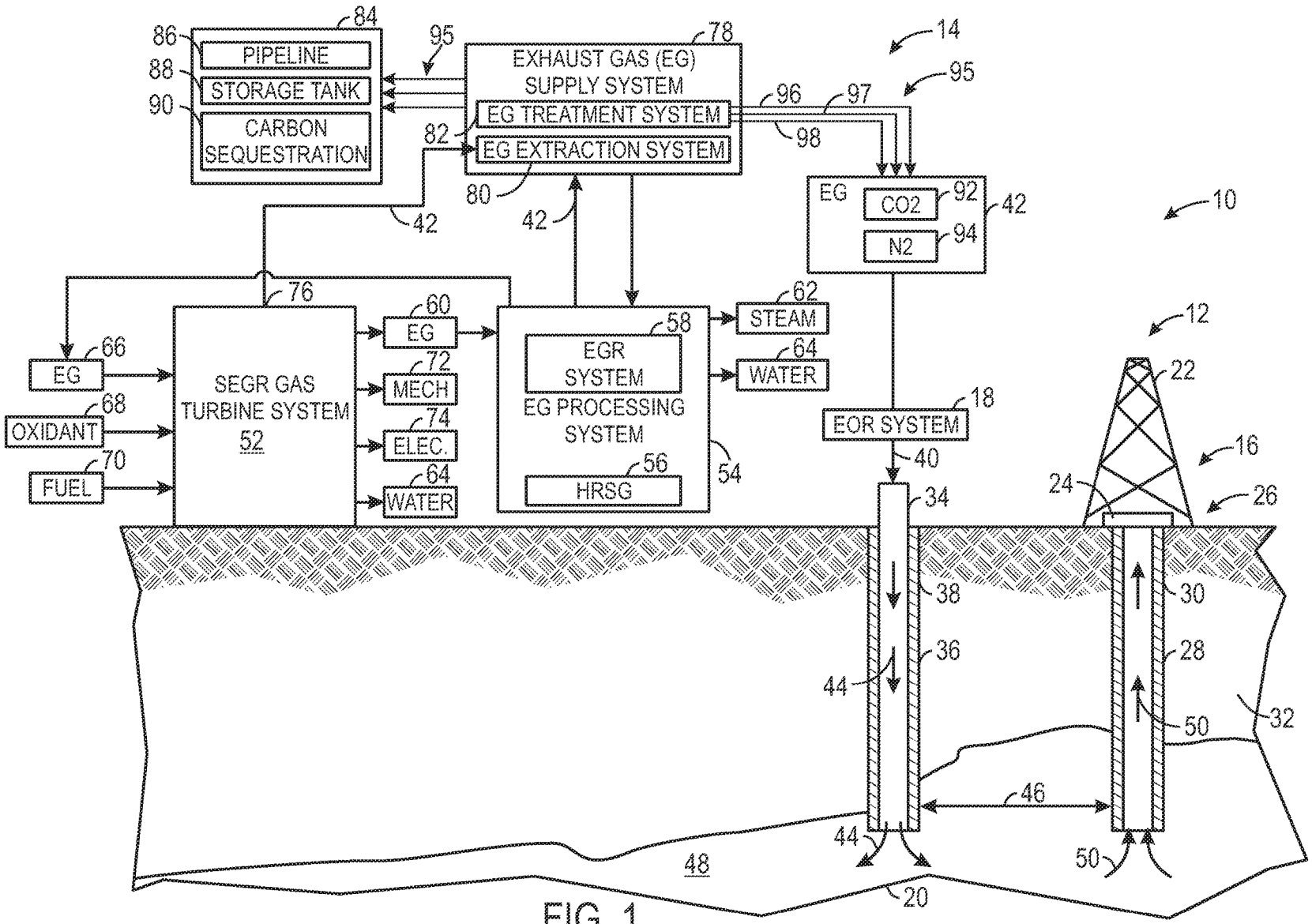
FIG. 1 is a diagram of an embodiment of a system having a turbine-based service system coupled to a hydrocarbon production system.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Accordingly, while example embodiments are capable of various modifications and alternative forms, embodiments thereof are illustrated by way of example in the figures and will herein be described in detail. It should be understood, however, that there is no intent to limit example embodiments to the particular forms disclosed, but to the contrary, example embodiments are to cover all modifications, equivalents, and alternatives falling within the scope of the present invention.

The terminology used herein is for describing particular embodiments only and is not intended to be limiting of example embodiments. As used herein, the singular forms "a", "an" and "the" are intended to include the plural forms as well, unless the context clearly indicates otherwise. The terms "comprises", "comprising", "includes" and/or "including", when used herein, specify the presence of stated features, integers, steps, operations, elements, and/or components, but do not preclude the presence or addition of one or more other features, integers, steps, operations, elements, components, and/or groups thereof.

Although the terms first, second, primary, secondary, etc. may be used herein to describe various elements, these elements should not be limited by these terms. These terms are only used to distinguish one element from another. For example, but not limiting to, a first element could be termed a second element, and, similarly, a second element could be termed a first element, without departing from the scope of example embodiments. As used herein, the term "and/or" includes any, and all, combinations of one or more of the associated listed items.

Certain terminology may be used herein for the convenience of the reader only and is not to be taken as a limitation on the scope of the invention. For example, words such as "upper", "lower", "left", "right", "front", "rear", "top", "bottom", "horizontal", "vertical", "upstream", "downstream", "fore", "aft", and the like; merely describe the configuration shown in the figures. Indeed, the element or elements of an embodiment of the present invention may be oriented in any direction and the terminology, therefore, should be understood as encompassing such variations unless specified otherwise.

As discussed in detail below, the disclosed embodiments relate generally to gas turbine systems with exhaust gas recirculation (EGR), and particularly stoichiometric operation of the gas turbine systems using EGR. For example, the gas turbine systems may be configured to recirculate the exhaust gas along an exhaust recirculation path, stoichiometrically combust fuel and oxidant along with at least some of the recirculated exhaust gas, and capture the exhaust gas for use in various target systems. The recirculation of the exhaust gas along with stoichiometric combustion may help to increase the concentration level of carbon dioxide ($CO_2$) in the exhaust gas, which can then be post treated to separate and purify the $CO_2$ and nitrogen ($N_2$) for use in various target systems. The gas turbine systems also may employ various exhaust gas processing (e.g., heat recovery, catalyst reactions, etc.) along the exhaust recirculation path, thereby increasing the concentration level of $CO_2$, reducing concentration levels of other emissions (e.g., carbon monoxide, nitrogen oxides, and unburnt hydrocarbons), and increasing energy recovery (e.g., with heat recovery units). Furthermore, the gas turbine engines may be configured to combust the fuel and oxidant with one or more diffusion flames (e.g., using diffusion fuel nozzles), premix flames (e.g., using premix fuel nozzles), or any combination thereof. In certain embodiments, the diffusion flames may help to maintain stability and operation within certain limits for stoichiometric combustion, which in turn helps to increase production of $CO_2$. For example, a gas turbine system operating with diffusion flames may enable a greater quantity of EGR, as compared to a gas turbine system operating with premix flames. In turn, the increased quantity of EGR helps to increase $CO_2$ production. Possible target systems include pipelines, storage tanks, carbon sequestration systems, and hydrocarbon production systems, such as enhanced oil recovery (EOR) systems.

In certain embodiments, cooling flows may be used to cool probes (e.g., sensors) that are coupled to various components of a gas turbine engine, such as a compressor, a compressor discharge casing, a combustor, and a turbine. In operating conditions, the various components of the gas turbine engine may be in a high temperature environment. For example, the compressor outlet may have a temperature of about 250° C. to 350° C., and the turbine outlet may have a temperature of about 500° C. to 600° C. When the probes are coupled to the components that operate in the high temperature environment, cooling flows (e.g., streams of compressed air, carbon dioxide, and nitrogen) may be routed to directly or indirectly contact the probes to facilitate cooling of the probes. For example, the probes may include one or more cooling passages surrounding at least a part of the probes, and the cooling flows may be directed to flow through the one or more cooling passages to absorb heat from the probe (e.g., via convection). After absorbing heat from the probe, the cooling flows exiting the one or more cooling passages may have high temperatures (e.g., above 80° C.) and high velocities (e.g., above 60 m/s). The exit temperatures and/or the exit velocities of the cooling flows may be subject to various regulatory requirements or other requirements. For example, regulations may require that the exit temperature of a cooling flow that is released into the atmosphere is no greater than a threshold level, such as 80° C. Accordingly, without the disclosed embodiments, separate piping (or conduits, or flow lines) may be coupled to the exit of the cooling passage to direct the high temperature and high velocity exit cooling flows to a remote location to process and/or release to the atmosphere.

The present disclosure provides an ejector that may be coupled to an exit of a cooling passage of a probe coupled to various components of a gas turbine engine operating in high temperature environment. The ejector may be coupled to the exit of the cooling passage to receive the exit cooling flow. The exit cooling flow may then flow into an interior of the ejector via a nozzle, which is configured to constrict the exit cooling flow. The ejector also includes an opening fluidly coupled to the interior and configured to receive a coolant (e.g., ambient air). As the exit cooling flow passes and is constricted by the nozzle, the exit cooling flow may draw the coolant from the ambient environment (e.g., outside of the ejector) into the interior of the ejector. The coolant and the constricted exit cooling flow may mix in a mixing portion of the interior of the ejector. The mixture may then be discharged into the atmosphere as a discharge flow. Because the exit cooling flow mixes with the coolant within the ejector, the discharge flow may have a lower temperature than the cooling flow exiting the cooling passage of the probe. For example, the discharge flow may have a temperature lower than the regulatory threshold, such that the discharge flow may be released directly from the ejector into the atmosphere without separate piping and/or heat exchangers. In addition, the ejector may include design features, for example, the discharge outlet of the ejector may have a diameter that is greater than a diameter of the exit of the cooling passage, such that the discharge flow has a lower velocity than the cooling flow exiting the cooling passage of the probe. As such, by incorporating the ejector to the exit of the cooling flowing passage, in accordance with the present disclosure, separate piping that directs the exit outflow to a remote location may be eliminated, and the exit cooling flow may be directly released to the atmosphere (e.g., via the ejector in close proximity of the probe).

FIG. 1 is a diagram of an embodiment of a system 10 having a hydrocarbon production system 12 associated with a turbine-based service system 14. As discussed in further detail below, various embodiments of the turbine-based service system 14 are configured to provide various services, such as electrical power, mechanical power, and fluids (e.g., exhaust gas), to the hydrocarbon production system 12 to facilitate the production or retrieval of oil and/or gas. In the illustrated embodiment, the hydrocarbon production system 12 includes an oil/gas extraction system 16 and an enhanced oil recovery (EOR) system 18, which are coupled to a subterranean reservoir 20 (e.g., an oil, gas, or hydrocarbon reservoir). The oil/gas extraction system 16 includes a variety of surface equipment 22, such as a Christmas tree or production tree 24, coupled to an oil/gas well 26. Furthermore, the well 26 may include one or more tubulars 28 extending through a drilled bore 30 in the earth 32 to the subterranean reservoir 20. The tree 24 includes one or more valves, chokes, isolation sleeves, blowout preventers, and various flow control devices, which regulate pressures and control flows to and from the subterranean reservoir 20. While the tree 24 is generally used to control the flow of the production fluid (e.g., oil or gas) out of the subterranean reservoir 20, the EOR system 18 may increase the production of oil or gas by injecting one or more fluids into the subterranean reservoir 20.

Accordingly, the EOR system 18 may include a fluid injection system 34, which has one or more tubulars 36 extending through a bore 38 in the earth 32 to the subterranean reservoir 20. For example, the EOR system 18 may route one or more fluids 40, such as gas, steam, water, chemicals, or any combination thereof, into the fluid injection system 34. For example, as discussed in further detail below, the EOR system 18 may be coupled to the turbine-based service system 14, such that the system 14 routes an exhaust gas 42 (e.g., substantially or entirely free of oxygen) to the EOR system 18 for use as the injection fluid 40. The fluid injection system 34 routes the fluid 40 (e.g., the exhaust gas 42) through the one or more tubulars 36 into the subterranean reservoir 20, as indicated by arrows 44. The injection fluid 40 enters the subterranean reservoir 20 through the tubular 36 at an offset distance 46 away from the tubular 28 of the oil/gas well 26. Accordingly, the injection fluid 40 displaces the oil/gas 48 disposed in the subterranean reservoir 20, and drives the oil/gas 48 up through the one or more tubulars 28 of the hydrocarbon production system 12, as indicated by arrows 50. As discussed in further detail below, the injection fluid 40 may include the exhaust gas 42 originating from the turbine-based service system 14, which is able to generate the exhaust gas 42 on-site as needed by the hydrocarbon production system 12. In other words, the turbine-based system 14 may simultaneously generate one or more services (e.g., electrical power, mechanical power, steam, water (e.g., desalinated water), and exhaust gas (e.g., substantially free of oxygen)) for use by the hydrocarbon production system 12, thereby reducing or eliminating the reliance on external sources of such services.

In the illustrated embodiment, the turbine-based service system 14 includes a stoichiometric exhaust gas recirculation (SEGR) gas turbine system 52 and an exhaust gas (EG) processing system 54. The gas turbine system 52 may be configured to operate in a stoichiometric combustion mode of operation (e.g., a stoichiometric control mode) and a non-stoichiometric combustion mode of operation (e.g., a non-stoichiometric control mode), such as a fuel-lean control mode or a fuel-rich control mode. In the stoichiometric control mode, the combustion generally occurs in a substantially stoichiometric ratio of a fuel and oxidant, thereby resulting in substantially stoichiometric combustion. In particular, stoichiometric combustion generally involves consuming substantially all of the fuel and oxidant in the combustion reaction, such that the products of combustion are substantially or entirely free of unburnt fuel and oxidant. One measure of stoichiometric combustion is the equivalence ratio, or phi ($\Phi$), which is the ratio of the actual fuel/oxidant ratio relative to the stoichiometric fuel/oxidant ratio. An equivalence ratio of greater than 1.0 results in a fuel-rich combustion of the fuel and oxidant, whereas an equivalence ratio of less than 1.0 results in a fuel-lean combustion of the fuel and oxidant. In contrast, an equivalence ratio of 1.0 results in combustion that is neither fuel-rich nor fuel-lean, thereby substantially consuming all of the fuel and oxidant in the combustion reaction. In context of the disclosed embodiments, the term stoichiometric or substantially stoichiometric may refer to an equivalence ratio of approximately 0.95 to approximately 1.05. However, the disclosed embodiments may also include an equivalence ratio of 1.0 plus or minus 0.01, 0.02, 0.03, 0.04, 0.05, or more. Again, the stoichiometric combustion of fuel and oxidant in the turbine-based service system 14 may result in products of combustion or exhaust gas (e.g., 42) with substantially no unburnt fuel or oxidant remaining. For example, the exhaust gas 42 may have less than 1, 2, 3, 4, or 5 percent by volume of oxidant (e.g., oxygen), unburnt fuel or hydrocarbons (e.g., HCs), nitrogen oxides (e.g., $NO_X$), carbon monoxide (CO), sulfur oxides (e.g., $SO_X$), hydrogen, and other products of incomplete combustion. By further example, the exhaust gas 42 may have less than approximately 10, 20, 30, 40, 50, 60, 70, 80, 90, 100, 200, 300, 400, 500, 1000, 2000, 3000, 4000, or 5000 parts per million by volume (ppmv) of oxidant (e.g., oxygen), unburnt fuel or hydrocarbons (e.g., HCs), nitrogen oxides (e.g., $NO_X$), carbon monoxide (CO), sulfur oxides (e.g., $SO_X$), hydrogen, and other products of incomplete combustion. However, the disclosed embodiments also may produce other ranges of residual fuel, oxidant, and other emissions levels in the exhaust gas 42. As used herein, the terms emissions, emissions levels, and emissions targets may refer to concentration levels of certain products of combustion (e.g., $NO_X$, CO, $SO_X$, $O_2$, $N_2$, $H_2$, HCs, etc.), which may be present in recirculated gas streams, vented gas streams (e.g., exhausted into the atmosphere), and gas streams used in various target systems (e.g., the hydrocarbon production system 12).

Although the SEGR gas turbine system 52 and the EG processing system 54 may include a variety of components in different embodiments, the illustrated EG processing system 54 includes a heat recovery steam generator (HRSG) 56 and an exhaust gas recirculation (EGR) system 58, which receive and process an exhaust gas 60 originating from the SEGR gas turbine system 52. The HRSG 56 may include one or more heat exchangers, condensers, and various heat recovery equipment, which collectively function to transfer heat from the exhaust gas 60 to a stream of water, thereby generating steam 62. The steam 62 may be used in one or more steam turbines, the EOR system 18, or any other portion of the hydrocarbon production system 12. For example, the HRSG 56 may generate low pressure, medium pressure, and/or high pressure steam 62, which may be selectively applied to low, medium, and high pressure steam turbine stages, or different applications of the EOR system 18. In addition to the steam 62, a treated water 64, such as a desalinated water, may be generated by the HRSG 56, the EGR system 58, and/or another portion of the EG processing system 54 or the SEGR gas turbine system 52. The treated water 64 (e.g., desalinated water) may be particularly useful in areas with water shortages, such as inland or desert regions. The treated water 64 may be generated, at least in part, due to the large volume of air driving combustion of fuel within the SEGR gas turbine system 52. While the on-site generation of steam 62 and water 64 may be beneficial in many applications (including the hydrocarbon production system 12), the on-site generation of exhaust gas 42, 60 may be particularly beneficial for the EOR system 18, due to its low oxygen content, high pressure, and heat derived from the SEGR gas turbine system 52. Accordingly, the HRSG 56, the EGR system 58, and/or another portion of the EG processing system 54 may output or recirculate an exhaust gas 66 into the SEGR gas turbine system 52, while also routing the exhaust gas 42 to the EOR system 18 for use with the hydrocarbon production system 12. Likewise, the exhaust gas 42 may be extracted directly from the SEGR gas turbine system 52 (i.e., without passing through the EG processing system 54) for use in the EOR system 18 of the hydrocarbon production system 12.

The exhaust gas recirculation is handled by the EGR system 58 of the EG processing system 54. For example, the EGR system 58 includes one or more conduits, valves, blowers, exhaust gas treatment systems (e.g., filters, particulate removal units, gas separation units, gas purification units, heat exchangers, heat recovery units, moisture removal units, catalyst units, chemical injection units, or any combination thereof), and controls to recirculate the exhaust gas along an exhaust gas circulation path from an output (e.g., discharged exhaust gas 60) to an input (e.g., intake exhaust gas 66) of the SEGR gas turbine system 52. In the illustrated embodiment, the SEGR gas turbine system 52 intakes the exhaust gas 66 into a compressor section having one or more compressors, thereby compressing the exhaust gas 66 for use in a combustor section along with an intake of an oxidant 68 and one or more fuels 70. The oxidant 68 may include ambient air, pure oxygen, oxygen-enriched air, oxygen-reduced air, oxygen-nitrogen mixtures, or any suitable oxidant that facilitates combustion of the fuel 70. The fuel 70 may include one or more gas fuels, liquid fuels, or any combination thereof. For example, the fuel 70 may include natural gas, liquefied natural gas (LNG), syngas, methane, ethane, propane, butane, naphtha, kerosene, diesel fuel, ethanol, methanol, biofuel, or any combination thereof.

The SEGR gas turbine system 52 mixes and combusts the exhaust gas 66, the oxidant 68, and the fuel 70 in the combustor section, thereby generating hot combustion gases or exhaust gas 60 to drive one or more turbine stages in a turbine section. In certain embodiments, each combustor in the combustor section includes one or more premix fuel nozzles, one or more diffusion fuel nozzles, or any combination thereof. For example, each premix fuel nozzle may be configured to mix the oxidant 68 and the fuel 70 internally within the fuel nozzle and/or partially upstream of the fuel nozzle, thereby injecting an oxidant-fuel mixture from the fuel nozzle into the combustion zone for a premixed combustion (e.g., a premixed flame). By further example, each diffusion fuel nozzle may be configured to isolate the flows of oxidant 68 and fuel 70 within the fuel nozzle, thereby separately injecting the oxidant 68 and the fuel 70 from the fuel nozzle into the combustion zone for diffusion combustion (e.g., a diffusion flame). In particular, the diffusion combustion provided by the diffusion fuel nozzles delays mixing of the oxidant 68 and the fuel 70 until the point of initial combustion, i.e., the flame region. In embodiments employing the diffusion fuel nozzles, the diffusion flame may provide increased flame stability, because the diffusion flame generally forms at the point of stoichiometry between the separate streams of oxidant 68 and fuel 70 (i.e., as the oxidant 68 and fuel 70 are mixing). In certain embodiments, one or more diluents (e.g., the exhaust gas 60, steam, nitrogen, or another inert gas) may be pre-mixed with the oxidant 68, the fuel 70, or both, in either the diffusion fuel nozzle or the premix fuel nozzle. In addition, one or more diluents (e.g., the exhaust gas 60, steam, nitrogen, or another inert gas) may be injected into the combustor at or downstream from the point of combustion within each combustor. The use of these diluents may help temper the flame (e.g., premix flame or diffusion flame), thereby helping to reduce $NO_X$ emissions, such as nitrogen monoxide (NO) and nitrogen dioxide ($NO_2$). Regardless of the type of flame, the combustion produces hot combustion gases or exhaust gas 60 to drive one or more turbine stages. As each turbine stage is driven by the exhaust gas 60, the SEGR gas turbine system 52 generates a mechanical power 72 and/or an electrical power 74 (e.g., via an electrical generator). The system 52 also outputs the exhaust gas 60, and may further output water 64. Again, the water 64 may be a treated water, such as a desalinated water, which may be useful in a variety of applications on-site or off-site.

Exhaust extraction is also provided by the SEGR gas turbine system 52 using one or more extraction points 76. For example, the illustrated embodiment includes an exhaust gas (EG) supply system 78 having an exhaust gas (EG) extraction system 80 and an exhaust gas (EG) treatment system 82, which receive exhaust gas 42 from the extraction points 76, treat the exhaust gas 42, and then supply or distribute the exhaust gas 42 to various target systems. The target systems may include the EOR system 18 and/or other systems, such as a pipeline 86, a storage tank 88, or a carbon sequestration system 90. The EG extraction system 80 may include one or more conduits, valves, controls, and flow separations, which facilitate isolation of the exhaust gas 42 from the oxidant 68, the fuel 70, and other contaminants, while also controlling the temperature, pressure, and flow rate of the extracted exhaust gas 42. The EG treatment system 82 may include one or more heat exchangers (e.g., heat recovery units such as heat recovery steam generators, condensers, coolers, or heaters), catalyst systems (e.g., oxidation catalyst systems), particulate and/or water removal systems (e.g., gas dehydration units, inertial separators, coalescing filters, water impermeable filters, and other filters), chemical injection systems, solvent based treatment systems (e.g., absorbers, flash tanks, etc.), carbon capture systems, gas separation systems, gas purification systems, and/or a solvent based treatment system, exhaust gas compressors, any combination thereof. These subsystems of the EG treatment system 82 enable control of the temperature, pressure, flow rate, moisture content (e.g., amount of water removal), particulate content (e.g., amount of particulate removal), and gas composition (e.g., percentage of $CO_2$, $N_2$, etc.).

The extracted exhaust gas 42 is treated by one or more subsystems of the EG treatment system 82, depending on the target system. For example, the EG treatment system 82 may direct all or part of the exhaust gas 42 through a carbon capture system, a gas separation system, a gas purification system, and/or a solvent based treatment system, which is controlled to separate and purify a carbonaceous gas (e.g., carbon dioxide) 92 and/or nitrogen ($N_2$) 94 for use in the various target systems. For example, embodiments of the EG treatment system 82 may perform gas separation and purification to produce a plurality of different streams 95 of exhaust gas 42, such as a first stream 96, a second stream 97, and a third stream 98. The first stream 96 may have a first composition that is rich in carbon dioxide and/or lean in nitrogen (e.g., a $CO_2$ rich, $N_2$ lean stream). The second stream 97 may have a second composition that has intermediate concentration levels of carbon dioxide and/or nitrogen (e.g., intermediate concentration $CO_2$, $N_2$ stream). The third stream 98 may have a third composition that is lean in carbon dioxide and/or rich in nitrogen (e.g., a $CO_2$ lean, $N_2$ rich stream). Each stream 95 (e.g., 96, 97, and 98) may include a gas dehydration unit, a filter, a gas compressor, or any combination thereof, to facilitate delivery of the stream 95 to a target system. In certain embodiments, the $CO_2$ rich, $N_2$ lean stream 96 may have a $CO_2$ purity or concentration level of greater than approximately 70, 75, 80, 85, 90, 95, 96, 97, 98, or 99 percent by volume, and a $N_2$ purity or concentration level of less than approximately 1, 2, 3, 4, 5, 10, 15, 20, 25, or 30 percent by volume. In contrast, the $CO_2$ lean, $N_2$ rich stream 98 may have a $CO_2$ purity or concentration level of less than approximately 1, 2, 3, 4, 5, 10, 15, 20, 25, or 30 percent by volume, and a $N_2$ purity or concentration level of greater than approximately 70, 75, 80, 85, 90, 95, 96, 97, 98, or 99 percent by volume. The intermediate concentration $CO_2$, $N_2$ stream 97 may have a $CO_2$ purity or concentration level and/or a $N_2$ purity or concentration level of between approximately 30 to 70, 35 to 65, 40 to 60, or 45 to 55 percent by volume. Although the foregoing ranges are merely non-limiting examples, the $CO_2$ rich, $N_2$ lean stream 96 and the $CO_2$ lean, $N_2$ rich stream 98 may be particularly well suited for use with the EOR system 18 and the other systems 84. However, any of these rich, lean, or intermediate concentration $CO_2$ streams 95 may be used, alone or in various combinations, with the EOR system 18 and the other systems 84. For example, the EOR system 18 and the other systems 84 (e.g., the pipeline 86, storage tank 88, and the carbon sequestration system 90) each may receive one or more $CO_2$ rich, $N_2$ lean streams 96, one or more $CO_2$ lean, $N_2$ rich streams 98, one or more intermediate concentration $CO_2$, $N_2$ streams 97, and one or more untreated exhaust gas 42 streams (i.e., bypassing the EG treatment system 82).

The EG extraction system 80 extracts the exhaust gas 42 at one or more extraction points 76 along the compressor section, the combustor section, and/or the turbine section, such that the exhaust gas 42 may be used in the EOR system 18 and other systems 84 at suitable temperatures and pressures. The EG extraction system 80 and/or the EG treatment system 82 also may circulate fluid flows (e.g., exhaust gas 42) to and from the EG processing system 54. For example, a portion of the exhaust gas 42 passing through the EG processing system 54 may be extracted by the EG extraction system 80 for use in the EOR system 18 and the other systems 84. In certain embodiments, the EG supply system 78 and the EG processing system 54 may be independent or integral with one another, and thus may use independent or common subsystems. For example, the EG treatment system 82 may be used by both the EG supply system 78 and the EG processing system 54. Exhaust gas 42 extracted from the EG processing system 54 may undergo multiple stages of gas treatment, such as one or more stages of gas treatment in the EG processing system 54 followed by one or more additional stages of gas treatment in the EG treatment system 82.

At each extraction point 76, the extracted exhaust gas 42 may be substantially free of oxidant 68 and fuel 70 (e.g., unburnt fuel or hydrocarbons) due to substantially stoichiometric combustion and/or gas treatment in the EG processing system 54. Furthermore, depending on the target system, the extracted exhaust gas 42 may undergo further treatment in the EG treatment system 82 of the EG supply system 78, thereby further reducing any residual oxidant 68, fuel 70, or other undesirable products of combustion. For example, either before or after treatment in the EG treatment system 82, the extracted exhaust gas 42 may have less than 1, 2, 3, 4, or 5 percent by volume of oxidant (e.g., oxygen), unburnt fuel or hydrocarbons (e.g., HCs), nitrogen oxides (e.g., $NO_X$), carbon monoxide (CO), sulfur oxides (e.g., $SO_X$), hydrogen, and other products of incomplete combustion. By further example, either before or after treatment in the EG treatment system 82, the extracted exhaust gas 42 may have less than approximately 10, 20, 30, 40, 50, 60, 70, 80, 90, 100, 200, 300, 400, 500, 1000, 2000, 3000, 4000, or 5000 parts per million by volume (ppmv) of oxidant (e.g., oxygen), unburnt fuel or hydrocarbons (e.g., HCs), nitrogen oxides (e.g., $NO_X$), carbon monoxide (CO), sulfur oxides (e.g., $SO_X$), hydrogen, and other products of incomplete combustion. Thus, the exhaust gas 42 is particularly well suited for use with the EOR system 18.

The EGR operation of the turbine system 52 specifically enables the exhaust extraction at a multitude of locations 76. For example, the compressor section of the system 52 may be used to compress the exhaust gas 66 without any oxidant 68 (i.e., only compression of the exhaust gas 66), such that a substantially oxygen-free exhaust gas 42 may be extracted from the compressor section and/or the combustor section prior to entry of the oxidant 68 and the fuel 70. The extraction points 76 may be located at interstage ports between adjacent compressor stages, at ports along the compressor discharge casing, at ports along each combustor in the combustor section, or any combination thereof. In certain embodiments, the exhaust gas 66 may not mix with the oxidant 68 and fuel 70 until it reaches the head end portion and/or fuel nozzles of each combustor in the combustor section. Furthermore, one or more flow separators (e.g., walls, dividers, baffles, or the like) may be used to isolate the oxidant 68 and the fuel 70 from the extraction points 76. With these flow separators, the extraction points 76 may be disposed directly along a wall of each combustor in the combustor section.

Once the exhaust gas 66, oxidant 68, and fuel 70 flow through the head end portion (e.g., through fuel nozzles) into the combustion portion (e.g., combustion chamber) of each combustor, the SEGR gas turbine system 52 is controlled to provide a substantially stoichiometric combustion of the exhaust gas 66, oxidant 68, and fuel 70. For example, the system 52 may maintain an equivalence ratio of approximately 0.95 to approximately 1.05. As a result, the products of combustion of the mixture of exhaust gas 66, oxidant 68, and fuel 70 in each combustor is substantially free of oxygen and unburnt fuel. Thus, the products of combustion (or exhaust gas) may be extracted from the turbine section of the SEGR gas turbine system 52 for use as the exhaust gas 42 routed to the EOR system 18. Along the turbine section, the extraction points 76 may be located at any turbine stage, such as interstage ports between adjacent turbine stages. Thus, using any of the foregoing extraction points 76, the turbine-based service system 14 may generate, extract, and deliver the exhaust gas 42 to the hydrocarbon production system 12 (e.g., the EOR system 18) for use in the production of oil/gas 48 from the subterranean reservoir 20.

Figure 2:
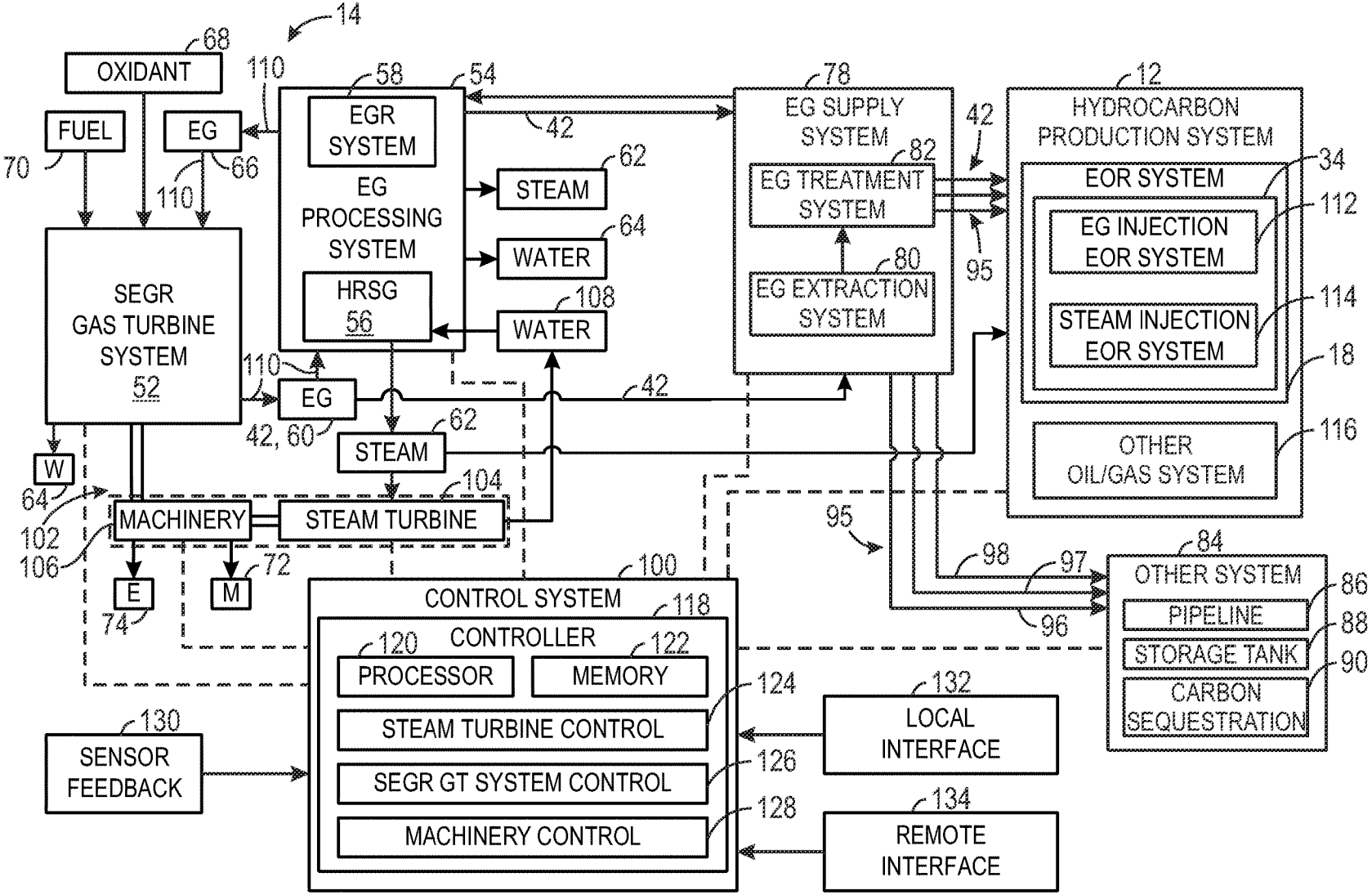
FIG. 2 is a diagram of an embodiment of the system of FIG. 1, further illustrating a control system and a combined cycle system.

FIG. 2 is a diagram of an embodiment of the system 10 of FIG. 1, illustrating a control system 100 coupled to the turbine-based service system 14 and the hydrocarbon production system 12. In the illustrated embodiment, the turbine-based service system 14 includes a combined cycle system 102, which includes the SEGR gas turbine system 52 as a topping cycle, a steam turbine 104 as a bottoming cycle, and the HRSG 56 to recover heat from the exhaust gas 60 to generate the steam 62 for driving the steam turbine 104. Again, the SEGR gas turbine system 52 receives, mixes, and stoichiometrically combusts the exhaust gas 66, the oxidant 68, and the fuel 70 (e.g., premix and/or diffusion flames), thereby producing the exhaust gas 60, the mechanical power 72, the electrical power 74, and/or the water 64. For example, the SEGR gas turbine system 52 may drive one or more loads or machinery 106, such as an electrical generator, an oxidant compressor (e.g., a main air compressor), a gear box, a pump, equipment of the hydrocarbon production system 12, or any combination thereof. In some embodiments, the machinery 106 may include other drives, such as electrical motors or steam turbines (e.g., the steam turbine 104), in tandem with the SEGR gas turbine system 52. Accordingly, an output of the machinery 106 driven by the SEGR gas turbines system 52 (and any additional drives) may include the mechanical power 72 and the electrical power 74. The mechanical power 72 and/or the electrical power 74 may be used on-site for powering the hydrocarbon production system 12, the electrical power 74 may be distributed to the power grid, or any combination thereof. The output of the machinery 106 also may include a compressed fluid, such as a compressed oxidant 68 (e.g., air or oxygen), for intake into the combustion section of the SEGR gas turbine system 52. Each of these outputs (e.g., the exhaust gas 60, the mechanical power 72, the electrical power 74, and/or the water 64) may be considered a service of the turbine-based service system 14.

The SEGR gas turbine system 52 produces the exhaust gas 42, 60, which may be substantially free of oxygen, and routes this exhaust gas 42, 60 to the EG processing system 54 and/or the EG supply system 78. The EG supply system 78 may treat and delivery the exhaust gas 42 (e.g., streams 95) to the hydrocarbon production system 12 and/or the other systems 84. As discussed above, the EG processing system 54 may include the HRSG 56 and the EGR system 58. The HRSG 56 may include one or more heat exchangers, condensers, and various heat recovery equipment, which may be used to recover or transfer heat from the exhaust gas 60 to water 108 to generate the steam 62 for driving the steam turbine 104. Similar to the SEGR gas turbine system 52, the steam turbine 104 may drive one or more loads or machinery 106, thereby generating the mechanical power 72 and the electrical power 74. In the illustrated embodiment, the SEGR gas turbine system 52 and the steam turbine 104 are arranged in tandem to drive the same machinery 106. However, in other embodiments, the SEGR gas turbine system 52 and the steam turbine 104 may separately drive different machinery 106 to independently generate mechanical power 72 and/or electrical power 74. As the steam turbine 104 is driven by the steam 62 from the HRSG 56, the steam 62 gradually decreases in temperature and pressure. Accordingly, the steam turbine 104 recirculates the used steam 62 and/or water 108 back into the HRSG 56 for additional steam generation via heat recovery from the exhaust gas 60. In addition to steam generation, the HRSG 56, the EGR system 58, and/or another portion of the EG processing system 54 may produce the water 64, the exhaust gas 42 for use with the hydrocarbon production system 12, and the exhaust gas 66 for use as an input into the SEGR gas turbine system 52. For example, the water 64 may be a treated water 64, such as a desalinated water for use in other applications. The desalinated water may be particularly useful in regions of low water availability. Regarding the exhaust gas 60, embodiments of the EG processing system 54 may be configured to recirculate the exhaust gas 60 through the EGR system 58 with or without passing the exhaust gas 60 through the HRSG 56.

In the illustrated embodiment, the SEGR gas turbine system 52 has an exhaust recirculation path 110, which extends from an exhaust outlet to an exhaust inlet of the system 52. Along the path 110, the exhaust gas 60 passes through the EG processing system 54, which includes the HRSG 56 and the EGR system 58 in the illustrated embodiment. The EGR system 58 may include one or more conduits, valves, blowers, gas treatment systems (e.g., filters, particulate removal units, gas separation units, gas purification units, heat exchangers, heat recovery units such as heat recovery steam generators, moisture removal units, catalyst units, chemical injection units, or any combination thereof) in series and/or parallel arrangements along the path 110. In other words, the EGR system 58 may include any flow control components, pressure control components, temperature control components, moisture control components, and gas composition control components along the exhaust recirculation path 110 between the exhaust outlet and the exhaust inlet of the system 52. Accordingly, in embodiments with the HRSG 56 along the path 110, the HRSG 56 may be considered a component of the EGR system 58. However, in certain embodiments, the HRSG 56 may be disposed along an exhaust path independent from the exhaust recirculation path 110. Regardless of whether the HRSG 56 is along a separate path or a common path with the EGR system 58, the HRSG 56 and the EGR system 58 intake the exhaust gas 60 and output either the recirculated exhaust gas 66, the exhaust gas 42 for use with the EG supply system 78 (e.g., for the hydrocarbon production system 12 and/or other systems 84), or another output of exhaust gas. Again, the SEGR gas turbine system 52 intakes, mixes, and stoichiometrically combusts the exhaust gas 66, the oxidant 68, and the fuel 70 (e.g., premixed and/or diffusion flames) to produce a substantially oxygen-free and fuel-free exhaust gas 60 for distribution to the EG processing system 54, the hydrocarbon production system 12, or other systems 84.

As noted above with reference to FIG. 1, the hydrocarbon production system 12 may include a variety of equipment to facilitate the recovery or production of oil/gas 48 from a subterranean reservoir 20 through an oil/gas well 26. For example, the hydrocarbon production system 12 may include the EOR system 18 having the fluid injection system 34. In the illustrated embodiment, the fluid injection system 34 includes an exhaust gas injection EOR system 112 and a steam injection EOR system 114. Although the fluid injection system 34 may receive fluids from a variety of sources, the illustrated embodiment may receive the exhaust gas 42 and the steam 62 from the turbine-based service system 14. The exhaust gas 42 and/or the steam 62 produced by the turbine-based service system 14 also may be routed to the hydrocarbon production system 12 for use in other oil/gas systems 116.

The quantity, quality, and flow of the exhaust gas 42 and/or the steam 62 may be controlled by the control system 100. The control system 100 may be dedicated entirely to the turbine-based service system 14, or the control system 100 may optionally also provide control (or at least some data to facilitate control) for the hydrocarbon production system 12 and/or other systems 84. In the illustrated embodiment, the control system 100 includes a controller 118 having a processor 120, a memory 122, a steam turbine control 124, a SEGR gas turbine system control 126, and a machinery control 128. The processor 120 may include a single processor or two or more redundant processors, such as triple redundant processors for control of the turbine-based service system 14. The memory 122 may include volatile and/or non-volatile memory. For example, the memory 122 may include one or more hard drives, flash memory, read-only memory, random access memory, or any combination thereof. The controls 124, 126, and 128 may include software and/or hardware controls. For example, the controls 124, 126, and 128 may include various instructions or code stored on the memory 122 and executable by the processor 120. The control 124 is configured to control operation of the steam turbine 104, the SEGR gas turbine system control 126 is configured to control the system 52, and the machinery control 128 is configured to control the machinery 106. Thus, the controller 118 (e.g., controls 124, 126, and 128) may be configured to coordinate various sub-systems of the turbine-based service system 14 to provide a suitable stream of the exhaust gas 42 to the hydrocarbon production system 12.

In certain embodiments of the control system 100, each element (e.g., system, subsystem, and component) illustrated in the drawings or described herein includes (e.g., directly within, upstream, or downstream of such element) one or more industrial control features, such as sensors and control devices, which are communicatively coupled with one another over an industrial control network along with the controller 118. For example, the control devices associated with each element may include a dedicated device controller (e.g., including a processor, memory, and control instructions), one or more actuators, valves, switches, and industrial control equipment, which enable control based on sensor feedback 130, control signals from the controller 118, control signals from a user, or any combination thereof. Thus, any of the control functionality described herein may be implemented with control instructions stored and/or executable by the controller 118, dedicated device controllers associated with each element, or a combination thereof.

In order to facilitate such control functionality, the control system 100 includes one or more sensors distributed throughout the system 10 to obtain the sensor feedback 130 for use in execution of the various controls, e.g., the controls 124, 126, and 128. For example, the sensor feedback 130 may be obtained from sensors distributed throughout the SEGR gas turbine system 52, the machinery 106, the EG processing system 54, the steam turbine 104, the hydrocarbon production system 12, or any other components throughout the turbine-based service system 14 or the hydrocarbon production system 12. For example, the sensor feedback 130 may include temperature feedback, pressure feedback, flow rate feedback, flame temperature feedback, combustion dynamics feedback, intake oxidant composition feedback, intake fuel composition feedback, exhaust composition feedback, the output level of mechanical power 72, the output level of electrical power 74, the output quantity of the exhaust gas 42, 60, the output quantity or quality of the water 64, or any combination thereof. For example, the sensor feedback 130 may include a composition of the exhaust gas 42, 60 to facilitate stoichiometric combustion in the SEGR gas turbine system 52. For example, the sensor feedback 130 may include feedback from one or more intake oxidant sensors along an oxidant supply path of the oxidant 68, one or more intake fuel sensors along a fuel supply path of the fuel 70, and one or more exhaust emissions sensors disposed along the exhaust recirculation path 110 and/or within the SEGR gas turbine system 52. The intake oxidant sensors, intake fuel sensors, and exhaust emissions sensors may include temperature sensors, pressure sensors, flow rate sensors, and composition sensors. The emissions sensors may includes sensors for nitrogen oxides (e.g., $NO_X$ sensors), carbon oxides (e.g., CO sensors and $CO_2$ sensors), sulfur oxides (e.g., $SO_X$ sensors), hydrogen (e.g., $H_2$ sensors), oxygen (e.g., $O_2$ sensors), unburnt hydrocarbons (e.g., HC sensors), or other products of incomplete combustion, or any combination thereof.

Using this feedback 130, the control system 100 may adjust (e.g., increase, decrease, or maintain) the intake flow of exhaust gas 66, oxidant 68, and/or fuel 70 into the SEGR gas turbine system 52 (among other operational parameters) to maintain the equivalence ratio within a suitable range, e.g., between approximately 0.95 to approximately 1.05, between approximately 0.95 to approximately 1.0, between approximately 1.0 to approximately 1.05, or substantially at 1.0. For example, the control system 100 may analyze the feedback 130 to monitor the exhaust emissions (e.g., concentration levels of nitrogen oxides, carbon oxides such as CO and $CO_2$, sulfur oxides, hydrogen, oxygen, unburnt hydrocarbons, and other products of incomplete combustion) and/or determine the equivalence ratio, and then control one or more components to adjust the exhaust emissions (e.g., concentration levels in the exhaust gas 42) and/or the equivalence ratio. The controlled components may include any of the components illustrated and described with reference to the drawings, including but not limited to, valves along the supply paths for the oxidant 68, the fuel 70, and the exhaust gas 66; an oxidant compressor, a fuel pump, or any components in the EG processing system 54; any components of the SEGR gas turbine system 52, or any combination thereof. The controlled components may adjust (e.g., increase, decrease, or maintain) the flow rates, temperatures, pressures, or percentages (e.g., equivalence ratio) of the oxidant 68, the fuel 70, and the exhaust gas 66 that combust within the SEGR gas turbine system 52. The controlled components also may include one or more gas treatment systems, such as catalyst units (e.g., oxidation catalyst units), supplies for the catalyst units (e.g., oxidation fuel, heat, electricity, etc.), gas purification and/or separation units (e.g., solvent based separators, absorbers, flash tanks, etc.), and filtration units. The gas treatment systems may help reduce various exhaust emissions along the exhaust recirculation path 110, a vent path (e.g., exhausted into the atmosphere), or an extraction path to the EG supply system 78.

In certain embodiments, the control system 100 may analyze the feedback 130 and control one or more components to maintain or reduce emissions levels (e.g., concentration levels in the exhaust gas 42, 60, 95) to a target range, such as less than approximately 10, 20, 30, 40, 50, 100, 200, 300, 400, 500, 1000, 2000, 3000, 4000, 5000, or 10000 parts per million by volume (ppmv). These target ranges may be the same or different for each of the exhaust emissions, e.g., concentration levels of nitrogen oxides, carbon monoxide, sulfur oxides, hydrogen, oxygen, unburnt hydrocarbons, and other products of incomplete combustion. For example, depending on the equivalence ratio, the control system 100 may selectively control exhaust emissions (e.g., concentration levels) of oxidant (e.g., oxygen) within a target range of less than approximately 10, 20, 30, 40, 50, 60, 70, 80, 90, 100, 250, 500, 750, or 1000 ppmv; carbon monoxide (CO) within a target range of less than approximately 20, 50, 100, 200, 500, 1000, 2500, or 5000 ppmv; and nitrogen oxides ($NO_X$) within a target range of less than approximately 50, 100, 200, 300, 400, or 500 ppmv. In certain embodiments operating with a substantially stoichiometric equivalence ratio, the control system 100 may selectively control exhaust emissions (e.g., concentration levels) of oxidant (e.g., oxygen) within a target range of less than approximately 10, 20, 30, 40, 50, 60, 70, 80, 90, or 100 ppmv; and carbon monoxide (CO) within a target range of less than approximately 500, 1000, 2000, 3000, 4000, or 5000 ppmv. In certain embodiments operating with a fuel-lean equivalence ratio (e.g., between approximately 0.95 to 1.0), the control system 100 may selectively control exhaust emissions (e.g., concentration levels) of oxidant (e.g., oxygen) within a target range of less than approximately 500, 600, 700, 800, 900, 1000, 1100, 1200, 1300, 1400, or 1500 ppmv; carbon monoxide (CO) within a target range of less than approximately 10, 20, 30, 40, 50, 60, 70, 80, 90, 100, 150, or 200 ppmv; and nitrogen oxides (e.g., $NO_X$) within a target range of less than approximately 50, 100, 150, 200, 250, 300, 350, or 400 ppmv. The foregoing target ranges are merely examples, and are not intended to limit the scope of the disclosed embodiments.

The control system 100 also may be coupled to a local interface 132 and a remote interface 134. For example, the local interface 132 may include a computer workstation disposed on-site at the turbine-based service system 14 and/or the hydrocarbon production system 12. In contrast, the remote interface 134 may include a computer workstation disposed off-site from the turbine-based service system 14 and the hydrocarbon production system 12, such as through an internet connection. These interfaces 132 and 134 facilitate monitoring and control of the turbine-based service system 14, such as through one or more graphical displays of sensor feedback 130, operational parameters, and so forth.

Again, as noted above, the controller 118 includes a variety of controls 124, 126, and 128 to facilitate control of the turbine-based service system 14. The steam turbine control 124 may receive the sensor feedback 130 and output control commands to facilitate operation of the steam turbine 104. For example, the steam turbine control 124 may receive the sensor feedback 130 from the HRSG 56, the machinery 106, temperature and pressure sensors along a path of the steam 62, temperature and pressure sensors along a path of the water 108, and various sensors indicative of the mechanical power 72 and the electrical power 74. Likewise, the SEGR gas turbine system control 126 may receive sensor feedback 130 from one or more sensors disposed along the SEGR gas turbine system 52, the machinery 106, the EG processing system 54, or any combination thereof. For example, the sensor feedback 130 may be obtained from temperature sensors, pressure sensors, clearance sensors, vibration sensors, flame sensors, fuel composition sensors, exhaust gas composition sensors, or any combination thereof, disposed within or external to the SEGR gas turbine system 52. Finally, the machinery control 128 may receive sensor feedback 130 from various sensors associated with the mechanical power 72 and the electrical power 74, as well as sensors disposed within the machinery 106. Each of these controls 124, 126, and 128 uses the sensor feedback 130 to improve operation of the turbine-based service system 14.

In the illustrated embodiment, the SEGR gas turbine system control 126 may execute instructions to control the quantity and quality of the exhaust gas 42, 60, 95 in the EG processing system 54, the EG supply system 78, the hydrocarbon production system 12, and/or the other systems 84. For example, the SEGR gas turbine system control 126 may maintain a level of oxidant (e.g., oxygen) and/or unburnt fuel in the exhaust gas 60 below a threshold suitable for use with the exhaust gas injection EOR system 112. In certain embodiments, the threshold levels may be less than 1, 2, 3, 4, or 5 percent of oxidant (e.g., oxygen) and/or unburnt fuel by volume of the exhaust gas 42, 60; or the threshold levels of oxidant (e.g., oxygen) and/or unburnt fuel (and other exhaust emissions) may be less than approximately 10, 20, 30, 40, 50, 60, 70, 80, 90, 100, 200, 300, 400, 500, 1000, 2000, 3000, 4000, or 5000 parts per million by volume (ppmv) in the exhaust gas 42, 60. By further example, in order to achieve these low levels of oxidant (e.g., oxygen) and/or unburnt fuel, the SEGR gas turbine system control 126 may maintain an equivalence ratio for combustion in the SEGR gas turbine system 52 between approximately 0.95 and approximately 1.05. The SEGR gas turbine system control 126 also may control the EG extraction system 80 and the EG treatment system 82 to maintain the temperature, pressure, flow rate, and gas composition of the exhaust gas 42, 60, 95 within suitable ranges for the exhaust gas injection EOR system 112, the pipeline 86, the storage tank 88, and the carbon sequestration system 90. As discussed above, the EG treatment system 82 may be controlled to purify and/or separate the exhaust gas 42 into one or more gas streams 95, such as the $CO_2$ rich, $N_2$ lean stream 96, the intermediate concentration $CO_2$, $N_2$ stream 97, and the $CO_2$ lean, $N_2$ rich stream 98. In addition to controls for the exhaust gas 42, 60, and 95, the controls 124, 126, and 128 may execute one or more instructions to maintain the mechanical power 72 within a suitable power range, or maintain the electrical power 74 within a suitable frequency and power range.

Figure 3:
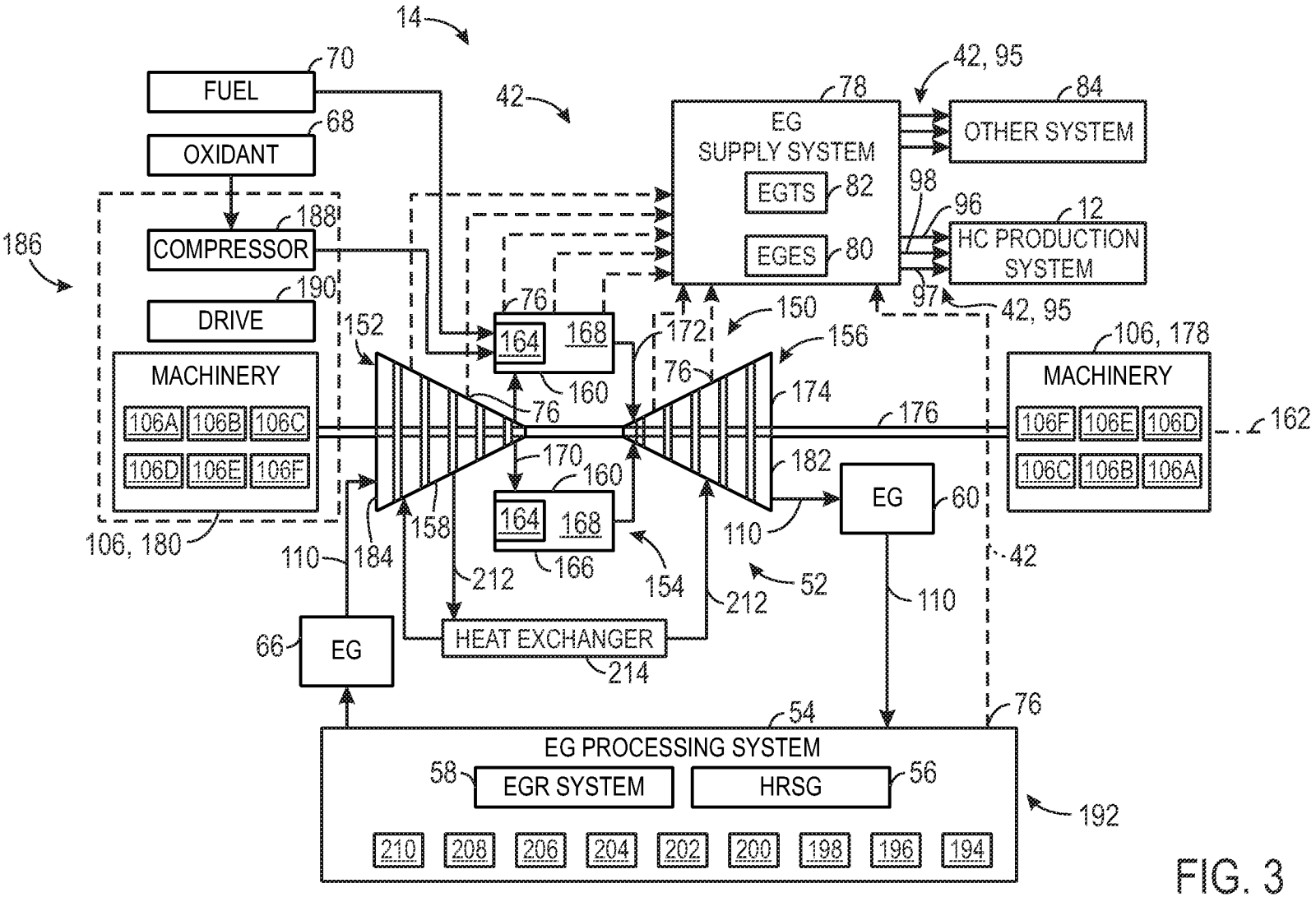
FIG. 3 is a diagram of an embodiment of the system of FIGS. 1 and 2, further illustrating details of a gas turbine engine, exhaust gas supply system, and exhaust gas processing system.

FIG. 3 is a diagram of embodiment of the system 10, further illustrating details of the SEGR gas turbine system 52 for use with the hydrocarbon production system 12 and/or other systems 84. In the illustrated embodiment, the SEGR gas turbine system 52 includes a gas turbine engine 150 coupled to the EG processing system 54. The illustrated gas turbine engine 150 includes a compressor section 152, a combustor section 154, and an expander section or turbine section 156. The compressor section 152 includes one or more exhaust gas compressors or compressor stages 158, such as 1 to 20 stages of rotary compressor blades disposed in a series arrangement. Likewise, the combustor section 154 includes one or more combustors 160, such as 1 to 20 combustors 160 distributed circumferentially about a rotational axis 162 of the SEGR gas turbine system 52. Furthermore, each combustor 160 may include one or more fuel nozzles 164 configured to inject the exhaust gas 66, the oxidant 68, and/or the fuel 70. For example, a head end portion 166 of each combustor 160 may house 1, 2, 3, 4, 5, 6, or more fuel nozzles 164, which may inject streams or mixtures of the exhaust gas 66, the oxidant 68, and/or the fuel 70 into a combustion portion 168 (e.g., combustion chamber) of the combustor 160.

The fuel nozzles 164 may include any combination of premix fuel nozzles 164 (e.g., configured to premix the oxidant 68 and fuel 70 for generation of an oxidant/fuel premix flame) and/or diffusion fuel nozzles 164 (e.g., configured to inject separate flows of the oxidant 68 and fuel 70 for generation of an oxidant/fuel diffusion flame). Embodiments of the premix fuel nozzles 164 may include swirl vanes, mixing chambers, or other features to internally mix the oxidant 68 and fuel 70 within the nozzles 164, prior to injection and combustion in the combustion chamber 168. The premix fuel nozzles 164 also may receive at least some partially mixed oxidant 68 and fuel 70. In certain embodiments, each diffusion fuel nozzle 164 may isolate flows of the oxidant 68 and the fuel 70 until the point of injection, while also isolating flows of one or more diluents (e.g., the exhaust gas 66, steam, nitrogen, or another inert gas) until the point of injection. In other embodiments, each diffusion fuel nozzle 164 may isolate flows of the oxidant 68 and the fuel 70 until the point of injection, while partially mixing one or more diluents (e.g., the exhaust gas 66, steam, nitrogen, or another inert gas) with the oxidant 68 and/or the fuel 70 prior to the point of injection. In addition, one or more diluents (e.g., the exhaust gas 66, steam, nitrogen, or another inert gas) may be injected into the combustor (e.g., into the hot products of combustion) either at or downstream from the combustion zone, thereby helping to reduce the temperature of the hot products of combustion and reduce emissions of $NO_X$ (e.g., NO and $NO_2$). Regardless of the type of fuel nozzle 164, the SEGR gas turbine system 52 may be controlled to provide substantially stoichiometric combustion of the oxidant 68 and fuel 70.

In diffusion combustion embodiments using the diffusion fuel nozzles 164, the fuel 70 and oxidant 68 generally do not mix upstream from the diffusion flame, but rather the fuel 70 and oxidant 68 mix and react directly at the flame surface and/or the flame surface exists at the location of mixing between the fuel 70 and oxidant 68. In particular, the fuel 70 and oxidant 68 separately approach the flame surface (or diffusion boundary/interface), and then diffuse (e.g., via molecular and viscous diffusion) along the flame surface (or diffusion boundary/interface) to generate the diffusion flame. It is noteworthy that the fuel 70 and oxidant 68 may be at a substantially stoichiometric ratio along this flame surface (or diffusion boundary/interface), which may result in a greater flame temperature (e.g., a peak flame temperature) along this flame surface. The stoichiometric fuel/oxidant ratio generally results in a greater flame temperature (e.g., a peak flame temperature), as compared with a fuel-lean or fuel-rich fuel/oxidant ratio. As a result, the diffusion flame may be substantially more stable than a premix flame, because the diffusion of fuel 70 and oxidant 68 helps to maintain a stoichiometric ratio (and greater temperature) along the flame surface. Although greater flame temperatures can also lead to greater exhaust emissions, such as $NO_X$ emissions, the disclosed embodiments use one or more diluents to help control the temperature and emissions while still avoiding any premixing of the fuel 70 and oxidant 68. For example, the disclosed embodiments may introduce one or more diluents separate from the fuel 70 and oxidant 68 (e.g., after the point of combustion and/or downstream from the diffusion flame), thereby helping to reduce the temperature and reduce the emissions (e.g., $NO_X$ emissions) produced by the diffusion flame.

In operation, as illustrated, the compressor section 152 receives and compresses the exhaust gas 66 from the EG processing system 54, and outputs a compressed exhaust gas 170 to each of the combustors 160 in the combustor section 154. Upon combustion of the fuel 60, oxidant 68, and exhaust gas 170 within each combustor 160, additional exhaust gas or products of combustion 172 (i.e., combustion gas) is routed into the turbine section 156. Similar to the compressor section 152, the turbine section 156 includes one or more turbines or turbine stages 174, which may include a series of rotary turbine blades. These turbine blades are then driven by the products of combustion 172 generated in the combustor section 154, thereby driving rotation of a shaft 176 coupled to the machinery 106. Again, the machinery 106 may include a variety of equipment coupled to either end of the SEGR gas turbine system 52, such as machinery 106, 178 coupled to the turbine section 156 and/or machinery 106, 180 coupled to the compressor section 152. In certain embodiments, the machinery 106, 178, 180 may include one or more electrical generators, oxidant compressors for the oxidant 68, fuel pumps for the fuel 70, gear boxes, or additional drives (e.g. steam turbine 104, electrical motor, etc.) coupled to the SEGR gas turbine system 52. Non-limiting examples are discussed in further detail below with reference to TABLE 1. As illustrated, the turbine section 156 outputs the exhaust gas 60 to recirculate along the exhaust recirculation path 110 from an exhaust outlet 182 of the turbine section 156 to an exhaust inlet 184 into the compressor section 152. Along the exhaust recirculation path 110, the exhaust gas 60 passes through the EG processing system 54 (e.g., the HRSG 56 and/or the EGR system 58) as discussed in detail above.

Again, each combustor 160 in the combustor section 154 receives, mixes, and stoichiometrically combusts the compressed exhaust gas 170, the oxidant 68, and the fuel 70 to produce the additional exhaust gas or products of combustion 172 to drive the turbine section 156. In certain embodiments, the oxidant 68 is compressed by an oxidant compression system 186, such as a main oxidant compression (MOC) system (e.g., a main air compression (MAC) system) having one or more oxidant compressors (MOCs). The oxidant compression system 186 includes an oxidant compressor 188 coupled to a drive 190. For example, the drive 190 may include an electric motor, a combustion engine, or any combination thereof. In certain embodiments, the drive 190 may be a turbine engine, such as the gas turbine engine 150. Accordingly, the oxidant compression system 186 may be an integral part of the machinery 106. In other words, the compressor 188 may be directly or indirectly driven by the mechanical power 72 supplied by the shaft 176 of the gas turbine engine 150. In such an embodiment, the drive 190 may be excluded, because the compressor 188 relies on the power output from the turbine engine 150. However, in certain embodiments employing more than one oxidant compressor is employed, a first oxidant compressor (e.g., a low pressure (LP) oxidant compressor) may be driven by the drive 190 while the shaft 176 drives a second oxidant compressor (e.g., a high pressure (HP) oxidant compressor), or vice versa. For example, in another embodiment, the HP MOC is driven by the drive 190 and the LP oxidant compressor is driven by the shaft 176. In the illustrated embodiment, the oxidant compression system 186 is separate from the machinery 106. In each of these embodiments, the compression system 186 compresses and supplies the oxidant 68 to the fuel nozzles 164 and the combustors 160. Accordingly, some or all of the machinery 106, 178, 180 may be configured to increase the operational efficiency of the compression system 186 (e.g., the compressor 188 and/or additional compressors).

The variety of components of the machinery 106, indicated by element numbers 106A, 106B, 106C, 106D, 106E, and 106F, may be disposed along the line of the shaft 176 and/or parallel to the line of the shaft 176 in one or more series arrangements, parallel arrangements, or any combination of series and parallel arrangements. For example, the machinery 106, 178, 180 (e.g., 106A through 106F) may include any series and/or parallel arrangement, in any order, of: one or more gearboxes (e.g., parallel shaft, epicyclic gearboxes), one or more compressors (e.g., oxidant compressors, booster compressors such as EG booster compressors), one or more power generation units (e.g., electrical generators), one or more drives (e.g., steam turbine engines, electrical motors), heat exchange units (e.g., direct or indirect heat exchangers), clutches, or any combination thereof. The compressors may include axial compressors, radial or centrifugal compressors, or any combination thereof, each having one or more compression stages. Regarding the heat exchangers, direct heat exchangers may include spray coolers (e.g., spray intercoolers), which inject a liquid spray into a gas flow (e.g., oxidant flow) for direct cooling of the gas flow. Indirect heat exchangers may include at least one wall (e.g., a shell and tube heat exchanger) separating first and second flows, such as a fluid flow (e.g., oxidant flow) separated from a coolant flow (e.g., water, air, refrigerant, or any other liquid or gas coolant), wherein the coolant flow transfers heat from the fluid flow without any direct contact. Examples of indirect heat exchangers include intercooler heat exchangers and heat recovery units, such as heat recovery steam generators. The heat exchangers also may include heaters. As discussed in further detail below, each of these machinery components may be used in various combinations as indicated by the non-limiting examples set forth in TABLE 1.

Generally, the machinery 106, 178, 180 may be configured to increase the efficiency of the compression system 186 by, for example, adjusting operational speeds of one or more oxidant compressors in the system 186, facilitating compression of the oxidant 68 through cooling, and/or extraction of surplus power. The disclosed embodiments are intended to include any and all permutations of the foregoing components in the machinery 106, 178, 180 in series and parallel arrangements, wherein one, more than one, all, or none of the components derive power from the shaft 176. As illustrated below, TABLE 1 depicts some non-limiting examples of arrangements of the machinery 106, 178, 180 disposed proximate and/or coupled to the compressor and turbine sections 152, 156.

TABLE 1

| 106A | 106B | 106C | 106D | 106E | 106F |
|---|---|---|---|---|---|
| MOC | GEN | | | | |
| MOC | GBX | GEN | | | |
| LP | HP | GEN | | | |
| MOC | MOC | | | | |
| HP | GBX | LP | GEN | | |
| MOC | | MOC | | | |
| MOC | GBX | GEN | | | |
| MOC | | | | | |
| HP | GBX | GEN | LP | | |
| MOC | | | MOC | | |
| MOC | GBX | GEN | | | |
| MOC | GBX | DRV | | | |
| DRV | GBX | LP | HP | GBX | GEN |
| | | MOC | MOC | | |

TABLE 1-continued

| 106A | 106B | 106C | 106D | 106E | 106F |
|---|---|---|---|---|---|
| DRV | GBX | HP | LP | GEN | |
| | | MOC | MOC | | |
| HP | GBX | LP | GEN | | |
| MOC | CLR | MOC | | | |
| HP | GBX | LP | GBX | GEN | |
| MOC | | MOC | | | |
| | CLR | | | | |
| HP | GBX | LP | GEN | | |
| MOC | HTR | MOC | | | |
| | STGN | | | | |
| MOC | GEN | DRV | | | |
| MOC | DRV | GEN | | | |
| DRV | MOC | GEN | | | |
| DRV | CLU | MOC | GEN | | |
| DRV | CLU | MOC | GBX | GEN | |

As illustrated above in TABLE 1, a cooling unit is represented as CLR, a clutch is represented as CLU, a drive is represented by DRV, a gearbox is represented as GBX, a generator is represented by GEN, a heating unit is represented by HTR, a main oxidant compressor unit is represented by MOC, with low pressure and high pressure variants being represented as LP MOC and HP MOC, respectively, and a steam generator unit is represented as STGN. Although TABLE 1 illustrates the machinery 106, 178, 180 in sequence toward the compressor section 152 or the turbine section 156, TABLE 1 is also intended to cover the reverse sequence of the machinery 106, 178, 180. In TABLE 1, any cell including two or more components is intended to cover a parallel arrangement of the components. TABLE 1 is not intended to exclude any non-illustrated permutations of the machinery 106, 178, 180. These components of the machinery 106, 178, 180 may enable feedback control of temperature, pressure, and flow rate of the oxidant 68 sent to the gas turbine engine 150. As discussed in further detail below, the oxidant 68 and the fuel 70 may be supplied to the gas turbine engine 150 at locations specifically selected to facilitate isolation and extraction of the compressed exhaust gas 170 without any oxidant 68 or fuel 70 degrading the quality of the exhaust gas 170.

The EG supply system 78, as illustrated in FIG. 3, is disposed between the gas turbine engine 150 and the target systems (e.g., the hydrocarbon production system 12 and the other systems 84). In particular, the EG supply system 78, e.g., the EG extraction system (EGES) 80), may be coupled to the gas turbine engine 150 at one or more extraction points 76 along the compressor section 152, the combustor section 154, and/or the turbine section 156. For example, the extraction points 76 may be located between adjacent compressor stages, such as 2, 3, 4, 5, 6, 7, 8, 9, or 10 interstage extraction points 76 between compressor stages. Each of these interstage extraction points 76 provides a different temperature and pressure of the extracted exhaust gas 42. Similarly, the extraction points 76 may be located between adjacent turbine stages, such as 2, 3, 4, 5, 6, 7, 8, 9, or 10 interstage extraction points 76 between turbine stages. Each of these interstage extraction points 76 provides a different temperature and pressure of the extracted exhaust gas 42. By further example, the extraction points 76 may be located at a multitude of locations throughout the combustor section 154, which may provide different temperatures, pressures, flow rates, and gas compositions. Each of these extraction points 76 may include an EG extraction conduit, one or more valves, sensors, and controls, which may be used to selectively control the flow of the extracted exhaust gas 42 to the EG supply system 78.

The extracted exhaust gas 42, which is distributed by the EG supply system 78, has a controlled composition suitable for the target systems (e.g., the hydrocarbon production system 12 and the other systems 84). For example, at each of these extraction points 76, the exhaust gas 170 may be substantially isolated from injection points (or flows) of the oxidant 68 and the fuel 70. In other words, the EG supply system 78 may be specifically designed to extract the exhaust gas 170 from the gas turbine engine 150 without any added oxidant 68 or fuel 70. Furthermore, in view of the stoichiometric combustion in each of the combustors 160, the extracted exhaust gas 42 may be substantially free of oxygen and fuel. The EG supply system 78 may route the extracted exhaust gas 42 directly or indirectly to the hydrocarbon production system 12 and/or other systems 84 for use in various processes, such as enhanced oil recovery, carbon sequestration, storage, or transport to an offsite location. However, in certain embodiments, the EG supply system 78 includes the EG treatment system (EGTS) 82 for further treatment of the exhaust gas 42, prior to use with the target systems. For example, the EG treatment system 82 may purify and/or separate the exhaust gas 42 into one or more streams 95, such as the $CO_2$ rich, $N_2$ lean stream 96, the intermediate concentration $CO_2$, $N_2$ stream 97, and the $CO_2$ lean, $N_2$ rich stream 98. These treated exhaust gas streams 95 may be used individually, or in any combination, with the hydrocarbon production system 12 and the other systems 84 (e.g., the pipeline 86, the storage tank 88, and the carbon sequestration system 90).

Similar to the exhaust gas treatments performed in the EG supply system 78, the EG processing system 54 may include a plurality of exhaust gas (EG) treatment components 192, such as indicated by element numbers 194, 196, 198, 200, 202, 204, 206, 208, and 210. These EG treatment components 192 (e.g., 194 through 210) may be disposed along the exhaust recirculation path 110 in one or more series arrangements, parallel arrangements, or any combination of series and parallel arrangements. For example, the EG treatment components 192 (e.g., 194 through 210) may include any series and/or parallel arrangement, in any order, of: one or more heat exchangers (e.g., heat recovery units such as heat recovery steam generators, condensers, coolers, or heaters), catalyst systems (e.g., oxidation catalyst systems), particulate and/or water removal systems (e.g., inertial separators, coalescing filters, water impermeable filters, and other filters), chemical injection systems, solvent based treatment systems (e.g., absorbers, flash tanks, etc.), carbon capture systems, gas separation systems, gas purification systems, and/or a solvent based treatment system, or any combination thereof. In certain embodiments, the catalyst systems may include an oxidation catalyst, a carbon monoxide reduction catalyst, a nitrogen oxides reduction catalyst, an aluminum oxide, a zirconium oxide, a silicone oxide, a titanium oxide, a platinum oxide, a palladium oxide, a cobalt oxide, or a mixed metal oxide, or a combination thereof. The disclosed embodiments are intended to include any and all permutations of the foregoing components 192 in series and parallel arrangements. As illustrated below, TABLE 2 depicts some non-limiting examples of arrangements of the components 192 along the exhaust recirculation path 110.

TABLE 2

| 194 | 196 | 198 | 200 | 202 | 204 | 206 | 208 | 210 |
|---|---|---|---|---|---|---|---|---|
| CU | HRU | BB | MRU | PRU | | | | |
| CU | HRU | HRU | BB | MRU | PRU | DIL | | |
| CU | HRSG | HRSG | BB | MRU | PRU | | | |
| OCU | HRU | OCU | HRU | OCU | BB | MRU | PRU | |
| HRU | HRU | BB | MRU | PRU | | | | |
| CU | CU | | | | | | | |
| HRSG | HRSG | BB | MRU | PRU | DIL | | | |
| OCU | OCU | | | | | | | |
| OCU | HRSG | OCU | HRSG | OCU | BB | MRU | PRU | DIL |
| | OCU | | OCU | | | | | |
| OCU | HRSG | HRSG | BB | COND | INER | WFIL | CFIL | DIL |
| | ST | ST | | | | | | |
| OCU | OCU | BB | COND | INER | FIL | DIL | | |
| HRSG | HRSG | | | | | | | |
| ST | ST | | | | | | | |
| OCU | HRSG | HRSG | OCU | BB | MRU | MRU | PRU | PRU |
| | ST | ST | | | HE | WFIL | INER | FIL |
| | | | | | COND | | | CFIL |
| CU | HRU | HRU | HRU | BB | MRU | PRU | PRU | DIL |
| | COND | COND | COND | | HE | INER | FIL | |
| | | | | | COND | | CFIL | |
| | | | | | WFIL | | | |

As illustrated above in TABLE 2, a catalyst unit is represented by CU, an oxidation catalyst unit is represented by OCU, a booster blower is represented by BB, a heat exchanger is represented by HX, a heat recovery unit is represented by HRU, a heat recovery steam generator is represented by HRSG, a condenser is represented by COND, a steam turbine is represented by ST, a particulate removal unit is represented by PRU, a moisture removal unit is represented by MRU, a filter is represented by FIL, a coalescing filter is represented by CFIL, a water impermeable filter is represented by WFIL, an inertial separator is represented by INER, and a diluent supply system (e.g., steam, nitrogen, or other inert gas) is represented by DIL. Although TABLE 2 illustrates the components 192 in sequence from the exhaust outlet 182 of the turbine section 156 toward the exhaust inlet 184 of the compressor section 152, TABLE 2 is also intended to cover the reverse sequence of the illustrated components 192. In TABLE 2, any cell including two or more components is intended to cover an integrated unit with the components, a parallel arrangement of the components, or any combination thereof. Furthermore, in context of TABLE 2, the HRU, the HRSG, and the COND are examples of the HE; the HRSG is an example of the HRU; the COND, WFIL, and CFIL are examples of the WRU; the INER, FIL, WFIL, and CFIL are examples of the PRU; and the WFIL and CFIL are examples of the FIL. Again, TABLE 2 is not intended to exclude any non-illustrated permutations of the components 192. In certain embodiments, the illustrated components 192 (e.g., 194 through 210) may be partially or completed integrated within the HRSG 56, the EGR system 58, or any combination thereof. These EG treatment components 192 may enable feedback control of temperature, pressure, flow rate, and gas composition, while also removing moisture and particulates from the exhaust gas 60. Furthermore, the treated exhaust gas 60 may be extracted at one or more extraction points 76 for use in the EG supply system 78 and/or recirculated to the exhaust inlet 184 of the compressor section 152.

As the treated, recirculated exhaust gas 66 passes through the compressor section 152, the SEGR gas turbine system 52 may bleed off a portion of the compressed exhaust gas along one or more lines 212 (e.g., bleed conduits or bypass conduits). Each line 212 may route the exhaust gas into one or more heat exchangers 214 (e.g., cooling units), thereby cooling the exhaust gas for recirculation back into the SEGR gas turbine system 52. For example, after passing through the heat exchanger 214, a portion of the cooled exhaust gas may be routed to the turbine section 156 along line 212 for cooling and/or sealing of the turbine casing, turbine shrouds, bearings, and other components. In such an embodiment, the SEGR gas turbine system 52 does not route any oxidant 68 (or other potential contaminants) through the turbine section 156 for cooling and/or sealing purposes, and thus any leakage of the cooled exhaust gas will not contaminate the hot products of combustion (e.g., working exhaust gas) flowing through and driving the turbine stages of the turbine section 156. By further example, after passing through the heat exchanger 214, a portion of the cooled exhaust gas may be routed along line 216 (e.g., return conduit) to an upstream compressor stage of the compressor section 152, thereby improving the efficiency of compression by the compressor section 152. In such an embodiment, the heat exchanger 214 may be configured as an interstage cooling unit for the compressor section 152. In this manner, the cooled exhaust gas helps to increase the operational efficiency of the SEGR gas turbine system 52, while simultaneously helping to maintain the purity of the exhaust gas (e.g., substantially free of oxidant and fuel).

Figure 4:
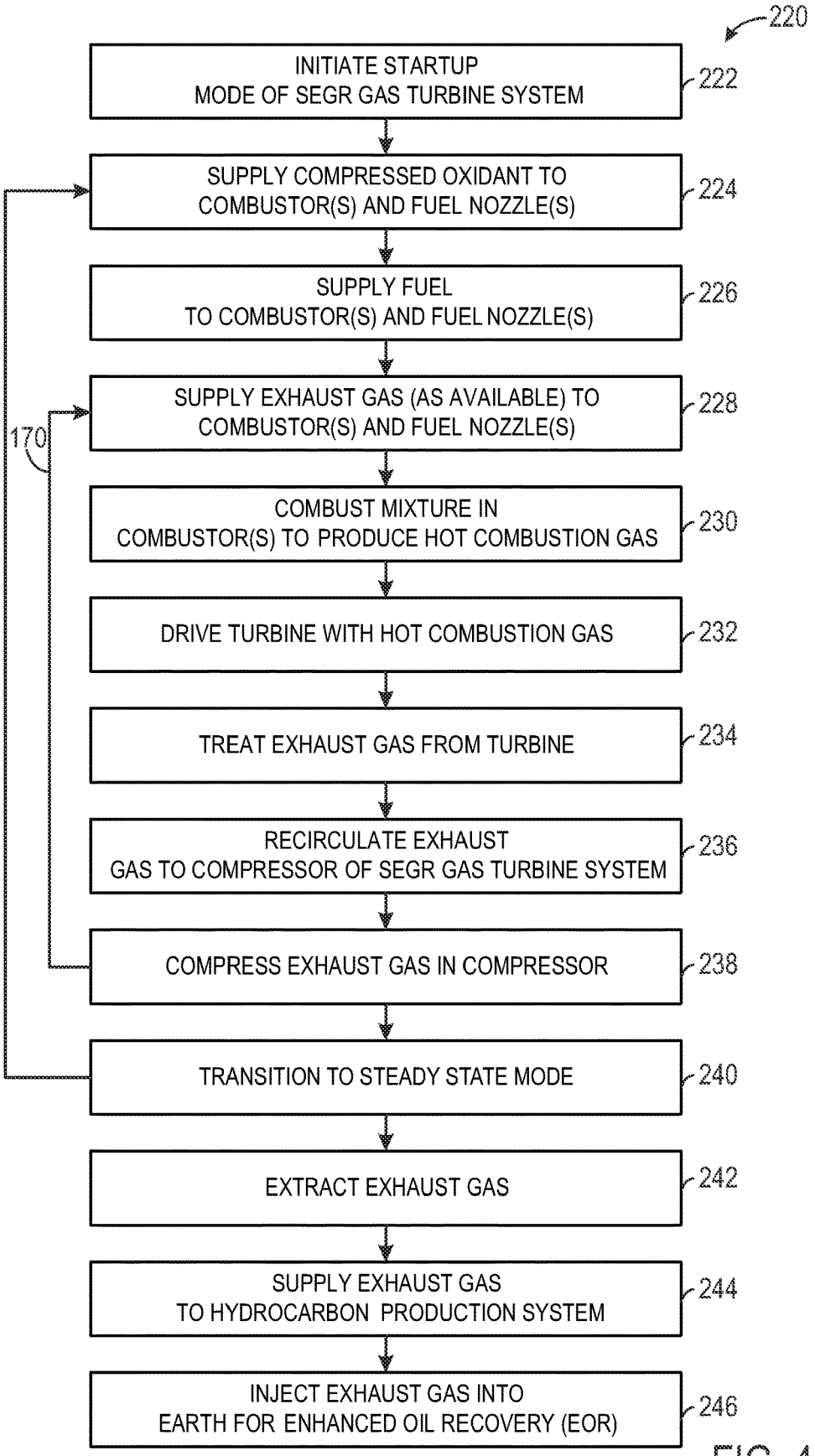
FIG. 4 is a flow chart of an embodiment of a process for operating the system of FIGS. 1-3.

FIG. 4 is a flow chart of an embodiment of an operational process 220 of the system 10 illustrated in FIGS. 1-3. In certain embodiments, the process 220 may be a computer implemented process, which accesses one or more instructions stored on the memory 122 and executes the instructions on the processor 120 of the controller 118 shown in FIG. 2. For example, each step in the process 220 may include instructions executable by the controller 118 of the control system 100 described with reference to FIG. 2.

The process 220 may begin by initiating a startup mode of the SEGR gas turbine system 52 of FIGS. 1-3, as indicated by block 222. For example, the startup mode may involve a gradual ramp up of the SEGR gas turbine system 52 to maintain thermal gradients, vibration, and clearance (e.g., between rotating and stationary parts) within acceptable thresholds. For example, during the startup mode 222, the process 220 may begin to supply a compressed oxidant 68 to the combustors 160 and the fuel nozzles 164 of the combustor section 154, as indicated by block 224. In certain embodiments, the compressed oxidant may include a compressed air, oxygen, oxygen-enriched air, oxygen-reduced air, oxygen-nitrogen mixtures, or any combination thereof. For example, the oxidant 68 may be compressed by the oxidant compression system 186 illustrated in FIG. 3. The process 220 also may begin to supply fuel to the combustors 160 and the fuel nozzles 164 during the startup mode 222, as indicated by block 226. During the startup mode 222, the process 220 also may begin to supply exhaust gas (as available) to the combustors 160 and the fuel nozzles 164, as indicated by block 228. For example, the fuel nozzles 164 may produce one or more diffusion flames, premix flames, or a combination of diffusion and premix flames. During the startup mode 222, the exhaust gas 60 being generated by the gas turbine engine 156 may be insufficient or unstable in quantity and/or quality. Accordingly, during the startup mode, the process 220 may supply the exhaust gas 66 from one or more storage units (e.g., storage tank 88), the pipeline 86, other SEGR gas turbine systems 52, or other exhaust gas sources.

The process 220 may then combust a mixture of the compressed oxidant, fuel, and exhaust gas in the combustors 160 to produce hot combustion gas 172, as indicated by block 230 by the one or more diffusion flames, premix flames, or a combination of diffusion and premix flames. In particular, the process 220 may be controlled by the control system 100 of FIG. 2 to facilitate stoichiometric combustion (e.g., stoichiometric diffusion combustion, premix combustion, or both) of the mixture in the combustors 160 of the combustor section 154. However, during the startup mode 222, it may be particularly difficult to maintain stoichiometric combustion of the mixture (and thus low levels of oxidant and unburnt fuel may be present in the hot combustion gas 172). As a result, in the startup mode 222, the hot combustion gas 172 may have greater amounts of residual oxidant 68 and/or fuel 70 than during a steady state mode as discussed in further detail below. For this reason, the process 220 may execute one or more control instructions to reduce or eliminate the residual oxidant 68 and/or fuel 70 in the hot combustion gas 172 during the startup mode.

The process 220 then drives the turbine section 156 with the hot combustion gas 172, as indicated by block 232. For example, the hot combustion gas 172 may drive one or more turbine stages 174 disposed within the turbine section 156. Downstream of the turbine section 156, the process 220 may treat the exhaust gas 60 from the final turbine stage 174, as indicated by block 234. For example, the exhaust gas treatment 234 may include filtration, catalytic reaction of any residual oxidant 68 and/or fuel 70, chemical treatment, heat recovery with the HRSG 56, and so forth. The process 220 may also recirculate at least some of the exhaust gas 60 back to the compressor section 152 of the SEGR gas turbine system 52, as indicated by block 236. For example, the exhaust gas recirculation 236 may involve passage through the exhaust recirculation path 110 having the EG processing system 54 as illustrated in FIGS. 1-3.

In turn, the recirculated exhaust gas 66 may be compressed in the compressor section 152, as indicated by block 238. For example, the SEGR gas turbine system 52 may sequentially compress the recirculated exhaust gas 66 in one or more compressor stages 158 of the compressor section 152. Subsequently, the compressed exhaust gas 170 may be supplied to the combustors 160 and fuel nozzles 164, as indicated by block 228. Steps 230, 232, 234, 236, and 238 may then repeat, until the process 220 eventually transitions to a steady state mode, as indicated by block 240. Upon the transition 240, the process 220 may continue to perform the steps 224 through 238, but may also begin to extract the exhaust gas 42 via the EG supply system 78, as indicated by block 242. For example, the exhaust gas 42 may be extracted from one or more extraction points 76 along the compressor section 152, the combustor section 154, and the turbine section 156 as indicated in FIG. 3. In turn, the process 220 may supply the extracted exhaust gas 42 from the EG supply system 78 to the hydrocarbon production system 12, as indicated by block 244. The hydrocarbon production system 12 may then inject the exhaust gas 42 into the earth 32 for enhanced oil recovery, as indicated by block 246. For example, the extracted exhaust gas 42 may be used by the exhaust gas injection EOR system 112 of the EOR system 18 illustrated in FIGS. 1-3.

As noted above, the control system 100 may include one or more sensors or probes distributed throughout the system 10 to obtain the sensor feedback 130 for use in execution of the various controls, e.g., the controls 124, 126, and 128. For example, the sensor feedback 130 may be obtained from sensors or probes distributed throughout the SEGR gas turbine system 52. As the various components of the SEGR gas turbine system 52 may operate in high temperature conditions, the probes coupled to the various components of the SEGR gas turbine system 52 may also operate in high temperature environments. As such, cooling flows may be used to cool the probes to facilitate operations and increase lifetime of the probes. When the cooling flows exit the probes, the cooling flows may have high temperatures and high velocities. In accordance with the present disclosure, ejectors are coupled to the probes such that the cooling flows exiting the probes may flow through the ejectors to be cooled and decelerated for discharging into the atmosphere.

Figure 5:
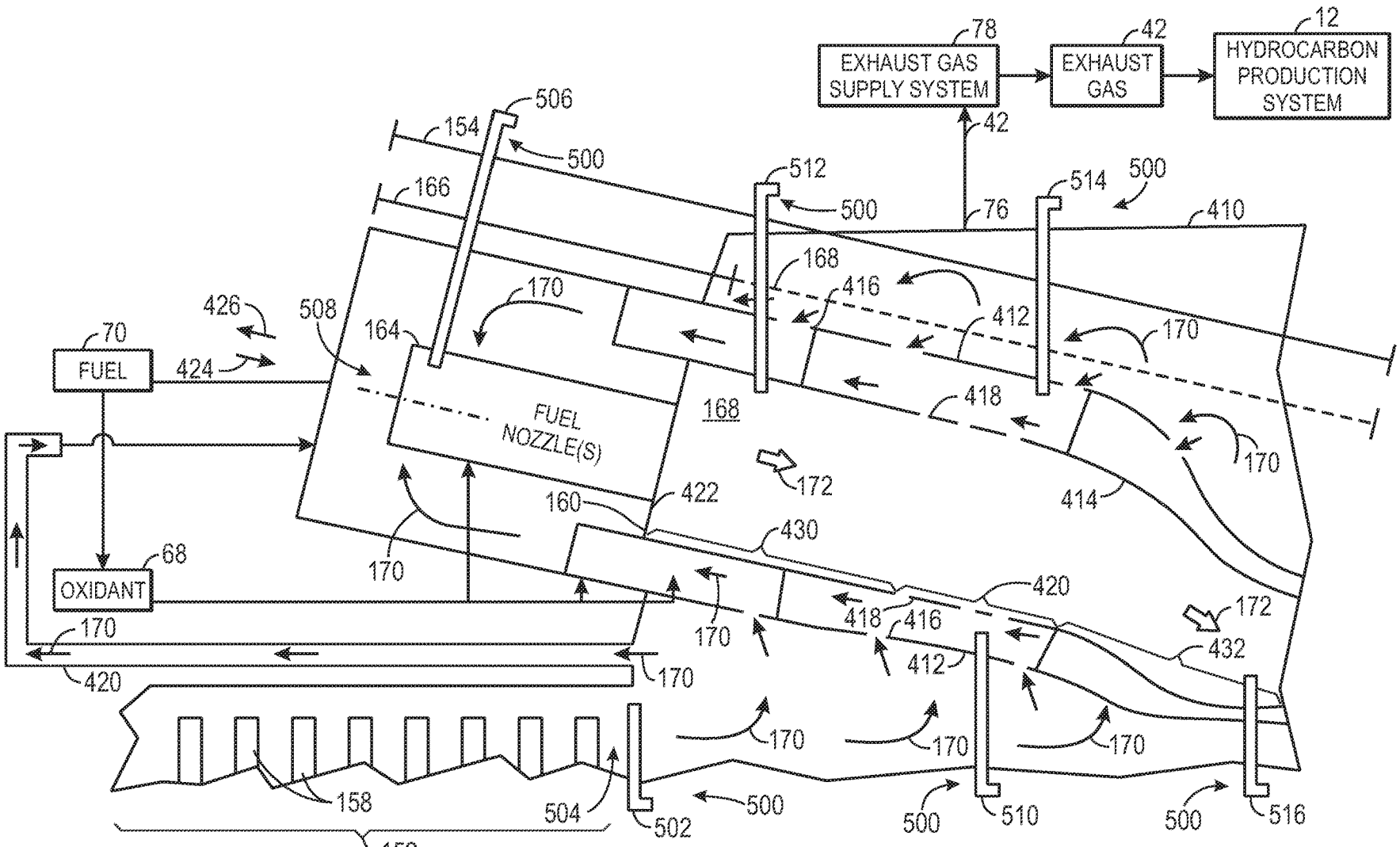
FIG. 5 is a schematic diagram of an embodiment of a gas turbine system, illustrating a compressor section and combustor section coupled with multiple probe-ejector assemblies.

FIG. 5 is a schematic diagram of the compressor section 152 and combustor section 154 of the SEGR gas turbine system 52 including multiple probe-ejector assemblies 500 in accordance with the present disclosure. The term "probe-ejector assembly" used herein refers to a probe or sensor with an ejector coupled thereto for cooling and decelerating a cooling flow exiting the probe. The probe may be any type of probe configured to monitor or sense one or more parameters of the various components of the system 10 and/or fluid flowing therein. For example, the probe may include a temperature probe, a pressure probe, a lambda probe (e.g., a $O_2$ sensor), a flow rate probe, a composition probe (e.g., a fuel sensor, a $NO_X$ sensor, a CO sensor, a $CO_2$ sensor, a $SO_X$ sensor, a $H_2$ sensor, or a HC sensor), a concentration probe, or any combination thereof. As illustrated in FIG. 5, the one or more probe-ejector assemblies 500 are coupled to various positions or parts of the compressor section 152 and combustor section 154 of the SEGR gas turbine system 52. However, it should be noted that the probe-ejector assembly 500 may be coupled to any components of the system 10, including any components of the hydrocarbon production system 12 and the turbine-based service system 14.

As illustrated, the compressor section 152 directs the compressed exhaust gas 170 from the compressor stages 158 into a compressor discharge casing 410. The compressor discharge casing 410 encloses at least part of the combustor 160 of the combustor section 154 (e.g., the combustion chamber 168), a combustor liner 414, and a flow sleeve 412. The flow sleeve 412 may direct the compressed exhaust gas 170 to the head end portion 166. In some embodiments, portions of the flow sleeve 412 also receive the oxidant 68. Gas (e.g., oxidant 68 and/or compressed exhaust gas 170) within the flow sleeve 412 may cool the combustor liner 414 that at least partially encloses the combustion chamber 168. The compressed exhaust gas 170 in the compressor discharge casing 410 may enter the flow sleeve 412 through passages 416. Some of the compressed exhaust gas 170, other diluent (e.g., steam, water), or oxidant 68 may enter the combustion chamber 168 through dilution holes 418 in the combustor liner 414. The dilution holes 418 may direct the compressed exhaust gas 170 and/or oxidant 68 into a dilution zone 420. As discussed above, some of the compressed exhaust gas 170 may be extracted through the extraction point 76 to the exhaust gas supply system 78 external to the compressor discharge casing 410. The exhaust gas supply system 78 may treat and supply the exhaust gas 42 to the hydrocarbon production system 12, such as for enhanced oil recovery. A cap 422 divides the combustor 160 into the head end portion 166 and the combustion chamber 168. The fuel nozzles 164 are positioned in the head end portion 166, and flames, if any, from combustion occur within the combustion chamber 168. The combustion gases 172 flow through the combustion chamber 168 primarily in a downstream direction 424 toward the turbine section 156. The compressed exhaust gas 170 and/or the oxidant 68 may flow through the flow sleeve 412 toward the head end portion 166 from the compressor section 152 in an upstream direction 426 relative to the combustion gases 172.

As illustrated in FIG. 5, the probe-ejector assemblies 500 may be disposed at various sections or parts of the compressor section 152 and combustor section 154 of the SEGR gas turbine system 52. For example, a first probe-ejector assembly 502 is disposed about an outlet 504 of the compressor section 152. A second probe-ejector assembly 506 is disposed about an inlet 508 of the fuel nozzles 164. A third probe-ejector assembly 510 is disposed in the flow sleeve 412. A fourth probe-ejector assembly 512 is disposed in a reaction zone 430 of the combustor section 154. A fifth probe-ejector assembly 514 is disposed in the dilution zone 430 of the combustor section 154. A sixth probe-ejector assembly 516 is disposed in a transition piece 432 of the combustor section 154.

As noted above, when in operation, various components of the compressor section 152 and combustor section 154 may be in high temperature conditions. For example, the outlet 504 of the compressor section 152 has a temperature of about 250° C. to 350° C., and the transition piece 432 of the combustor section 154 has a temperature of about 800° C. to 1350° C. A cooling flow is used to cool each of the probes in the probe-ejector assemblies 500 (e.g., the first, second, third, fourth, fifth, sixth probe-ejector assemblies 502, 506, 510, 512, 514, 516). The cooling flow becomes a heated outflow after cooling the probe, and the heated outflow is directed to the respective ejector in the probe-ejector assemblies 500. Each ejector in the probe-ejector assemblies 500, as discussed in greater detail below, cools the heated outflow (e.g., below a threshold or a range of temperature) and decelerates the outflow (e.g., below a threshold or a range of velocity), thereby releasing the cooled and decelerated outflow to the atmosphere. Also, as discussed in greater detail below, each ejector in the probe-ejector assemblies 500 may draw ambient air as a coolant into the respective ejector to mix with the heated outflow. As such, each of the probe-ejector assemblies 500, as illustrated in FIG. 5, includes at least a portion that is exposed to the atmosphere about the SEGR gas turbine system 52.

Figure 6:
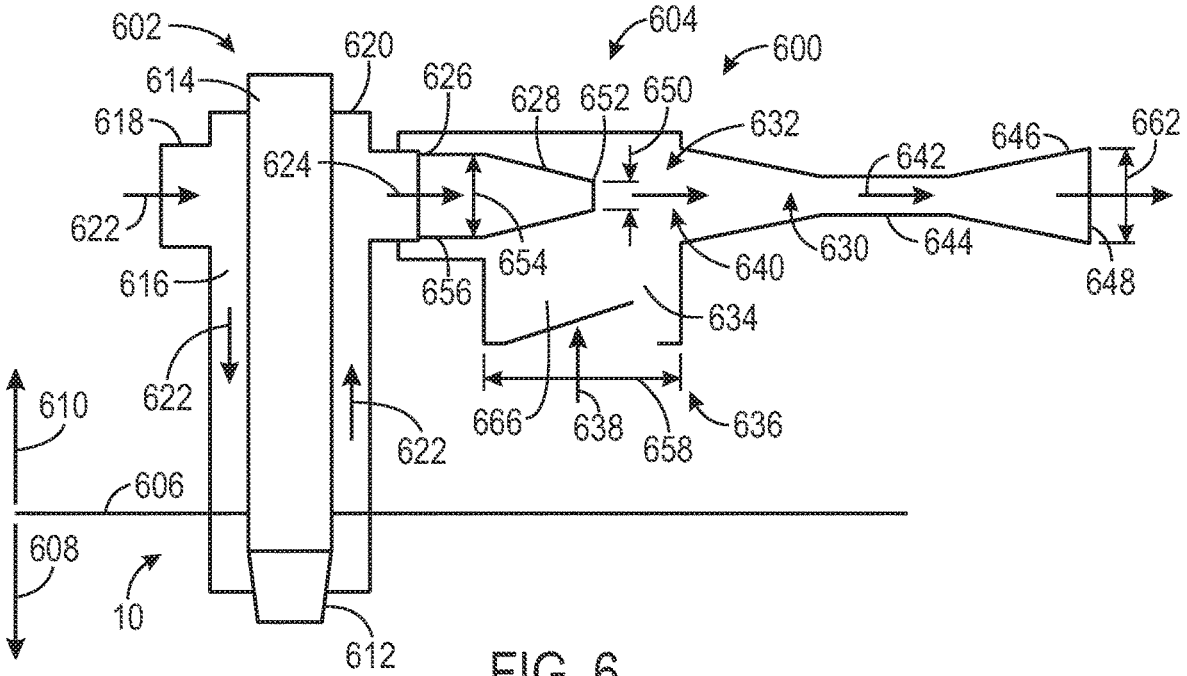
FIG. 6 is a cross-sectional view of an embodiment of a probe-ejector assembly.

FIG. 6 is a cross-sectional view of an embodiment of the probe-ejector assembly 500 (e.g., a seventh probe-ejector assembly 600) in accordance with the present disclosure. The seventh probe-ejector assembly 600 includes a probe 602 and an ejector 604. The probe 602 is coupled to (e.g., disposed in) any suitable components of the system 10, for example, through a sidewall 606. The sidewall 606 may represent a single wall or multiple walls, casings, shrouds, housings, and/or other structures. Furthermore, the probe 602 may be disposed at any suitable location. One side (e.g., warm side) of the sidewall 606, as illustrated by a direction 608, may be in high temperature conditions (e.g., greater than approximately 200° C.). The other side (e.g., cool side) of the side wall 606, as illustrated by a direction 610, may be exposed to ambient air (e.g., with a temperature of less than approximately 40° C., such as less than approximately 35° C., 30° C., 25° C., 20° C., 15° C., 10° C., or 5° C.). In some embodiments, the other side 610 of the sidewall 606 is exposed to a fluid (e.g., air) within another component of the system 10, such as a contained air flow cooling path.

The probe 602 includes a sensing component 612 configured to sense a parameter of the system 10. The probe 602 may be any type of probe, and the sensing component 612 may be configured to sense any suitable parameters of the system 10, including, but not limited to, temperature, pressure, flow rate, gas composition, gas concentration (e.g., $O_2$ content, $CO_2$ content, $NO_X$ content, $SO_X$ content), electrical current, electrical power, magnetic field, and volume. For example, the probe 602 may include a temperature probe (e.g., a thermocouple), a pressure probe, a lambda probe (e.g., a $O_2$ sensor), a flow rate probe, a composition probe (e.g., a fuel sensor, a $NO_X$ sensor, a CO sensor, a $CO_2$ sensor, a $SO_X$ sensor, a $H_2$ sensor, or a HC sensor), a concentration probe, an electric probe (e.g., a current probe), an electromagnetic probe (e.g., an Eddy current probe), or any combination thereof. The probe 602 also includes a body 614 coupled to the sensing component 612. The body 614 may include any functional components (e.g., processor, memory, connecting circuitry, display, and/or user input) suitable for the operation of the probe 602.

When the system 10 operates in high temperature conditions, all or a portion of the probe 602, including the sensing component 612 and the body 614, may be at high temperatures. For example, the sensing component 612 may be on the warm side 608 of the side wall 606. As such, the probe 602 may be cooled for improved measurement accuracy and/or extended lifetime. The probe 602 includes a cooling passage 616 disposed along at least a portion of the probe 602. The cooling passage 616 may be a flow path, a conduit, an annulus, or a shell that is completely or partially enclosing the probe 602. The cooling passage 616 includes an inlet 618 and an outlet 620. The inlet 616 is configured to receive a cooling inflow 622. As the cooling inflow 622 flows through the cooling passage 616, the cooling inflow 622 absorbs heat from the probe 602, thereby cooling the probe 602. A cool probe 602 may facilitate the operation of and increase the lifetime of the probe 602. As the cooling inflow 622 absorbs the heat from the probe 602, the cooling inflow 622 becomes heated to form an outflow 624 exiting the outlet 620. The cooling inflow may be any suitable fluid, including air, carbon dioxide, nitrogen, argon, water, steam, exhaust gas (e.g., the compressed exhaust gas 170, or recirculated exhaust gas from various components of the system 10), or any combination thereof.

In some embodiments, the cooling passage 616 is closed with respect to the system 10. For example, the cooling inflow 622 only flows into the cooling passage 616 via the inlet 618 and exits out of the cooling passage 616 via the outlet 620 (as the outflow 624). In other embodiments, the cooling passage 616 is open to the system 10. For example, the cooling passage 616 may include one or more openings to the system 10 near the sensing component 612. As such, a portion of the cooling inflow 622 may flow out of the cooling passage 616, or a portion of fluid (e.g., oxidant, fuel, exhaust gas) present in the system 10 may flow into the cooling passage 616. Accordingly, outflow 624 may include not all, but a portion of, the cooling inflow 622.

As illustrated, the ejector 604 includes an ejector inlet 626. The ejector inlet 626 is fluidly coupled to the outlet 620 of the probe 602. The outflow 624 enters the ejector 604 via the ejector inlet 626 and flows through a nozzle 628 (e.g., a converging conduit such as a conical conduit) into an interior 630 of the ejector 604. As the outflow 624 flows through the nozzle 628, the velocity of the outflow 624 increases and a low pressure area 632 forms at or near an exit of the nozzle 628. The low pressure area 632 creates a suction force within a coolant passage 634 of the ejector 604. As shown, the coolant passage 634 is formed about the nozzle 628 and includes an opening 636 through which a coolant 638 may flow. The suction force within the coolant passage 634 created by the low pressure area 632 draws the coolant 638 into the coolant passage 634 through the opening 636. The coolant 638 flows into the coolant passage 634 and, subsequently, flows into a mixing portion 640 (e.g., downstream of the low pressure area 632) where the coolant 638 mixes with the outflow 624 to form a discharge flow 642. The mixing portion 640 is a converging conduit or section, such as a conical conduit. Thereafter, the discharge flow 642 continues through a throat portion 644 (e.g., a reduced width conduit or minimum diameter section, such as a venturi section) and a diffuser portion 646 (e.g., a diverging conduit or section) to exit the ejector 604 through an ejector outlet 648. It should be noted that the various sections (e.g., the nozzle 628, the coolant passage 634, the throat portion 644, and the diffuser portion 646) of the ejector 604 may have any suitable shape or configurations, such as circular, oval, square, rectangular, or the like, or any combination thereof.

As noted above, the cooling inflow 622 absorbs the heat from the probe 602 and becomes the heated outflow 624 exiting the outlet 620 of the cooling passage 616. The coolant 638 drawn into the ejector 604 has a lower temperature than the outflow 624 and, when mixing with the outflow 624 in the ejector 604, decreases the temperature of the outflow 624. Consequently, the discharge flow 642 exiting the ejector 604 may have a lower temperature than the outflow 624 that enters the ejector 604. For example, the outflow 624 has a temperature of greater than approximately 80° C., such as between approximately 80° C. and 1800° C., between approximately 90° C. and 1700° C., between approximately 100° C. and 1600° C., between approximately 120° C. and 1500° C., between approximately 140° C. and 1400° C., between approximately 160° C. and 1300° C., between approximately 180° C. and 1200° C., between approximately 200° C. and 1100° C., between approximately 250° C. and 1000° C., between approximately 300° C. and 900° C., between approximately 400° C. and 800° C., or between approximately 500° C. and 700° C. The coolant 638 has a temperature of less than approximately 40° C., such as between approximately 40° C. and 0° C., between approximately 35° C. and 0° C., between approximately 30° C. and 5° C., between approximately 25° C. and 10° C., or between approximately 20° C. and 15° C. The discharge flow 642 has a temperature of less than approximately 80° C., such as between approximately 80° C. and 0° C., between approximately 75° C. and 0° C., between approximately 70° C. and 5° C., between approximately 65° C. and 10° C., between approximately 60° C. and 15° C., between approximately 55° C. and 20° C., between approximately 50° C. and 25° C., between approximately 45° C. and 30° C., or between approximately 40° C. and 35° C. The coolant 638 may be any suitable fluid, including, but not limited to, air (e.g., ambient air, compressed air, or air stream from an air supply unit), water, any other liquid or gas coolant, or a combination thereof.

As noted above, the temperature of the discharge flow 642 depends at least on the temperature of the outflow 624 and the temperature of the coolant 638. In addition, the flow rate (or amount) of the outflow 624 exiting the nozzle 628 and the flow rate (or amount) of the coolant entering the ejector 604 through the opening 636 may affect the temperature of the discharge flow 642. For example, with the same amount of the outflow 624 exiting the nozzle 628, increasing the quantity of the coolant 638 that enters through the opening 636 to mix with the outflow 624 may result in a lower temperature of the discharge flow 642. The flow rate of the outflow 624 exiting the nozzle 628 may in turn depend at least on the configuration of the nozzle 628, such as a ratio of a size (e.g., a diameter 650) of a tip 652 of the nozzle 628 to a size (e.g., a diameter 654) of an inlet 656 of the nozzle 628. The flow rate of the coolant 638 entering through the opening 636 may in turn depend at least on the size (e.g., a diameter 658) of the opening 636. In some embodiments, the ejector 604 includes a door 660 coupled to the opening 636. The door 660 is controlled (e.g., via a controller) to change the size of the opening 636, thereby adjusting the flow rate and/or amount of the coolant 638 through the opening 636. For example, the door 660 may be a check valve (e.g., responsive to a certain setpoint pressure or flow rate), and the controller may adjust the setpoint to control opening and closing of the check valve to control the flow rate (or the quantity) of the coolant 638 drawn into the ejector 604. In certain embodiments, the door 660 may be a motorized valve, and the controller may control the motorized valve to open and close to any certain degree based on control signals (e.g., currents, voltages, pressures, temperatures, or the like). As noted above, by controlling the size of the opening 636, the temperature and/or flow rate of the discharge flow 642 exiting the ejector 604 may be adjusted. For example, by increasing the size of the opening 636, the temperature of the discharge flow 642 exiting the ejector 604 may decrease. By decreasing the size of the opening 636, the temperature of the discharge flow 642 exiting the ejector 604 may increase.

The ejector 604 is also formed in such a shape to increase the cross sectional area of the interior 630, thereby having an effect of reducing the velocity of the mixture of the outflow 624 and the coolant 638 as the mixture flowing through the throat portion 644 and the diffuser portion 646. In other words, the discharge flow 642 exiting the ejector 604 may have a lower velocity than the outflow 624 entering the ejector 604. For example, the diffuser portion 646 includes a diverging conduit with a size (e.g., a diameter 662) at the ejector outlet 648 greater than the size (e.g., the diameter 654) of the inlet 656 of the nozzle 628. As such, the diffuser portion 646 has an effect of converting at least a portion of the velocity energy of the mixture to the pressure energy thereof. In some embodiments, the velocity of the discharge flow 642 exiting the ejector 604 is less than 95%, such as 90%, 85%, 80%, 75%, 70%, 65%, 60%, 55%, 50%, 45%, 40%, 35%, 30%, 25%, 20%, 15%, 10%, or 5%, of the velocity of the outflow 624 exiting the probe 602. In certain embodiments, the velocity of the discharge flow 642 exiting the ejector 604 is less than 60 m/s, such as 55 m/s, 50 m/s, 45 m/s, 40 m/s, 35 m/s, 30 m/s, 25 m/s, 20 m/s, 15 m/s, 10 m/s, 5 m/s, 2 m/s, or 1 m/s.

As will be appreciated, the discharge flow 642 exiting the ejector 604 has a lower temperature and a lower velocity compared to the outflow 624 exiting the probe 602. The discharge flow 642 may be released directly to the atmosphere. Thus, separate piping (and/or heat exchangers) for directing the high temperature and high velocity cooling flows from the exit of the cooling passage to a remote location for releasing may be eliminated. Also, separate heat exchangers (e.g., disposed in the remote location) for cooling the high temperature cooling flows exiting the cooling passage may be eliminated. Moreover, as will be appreciated, the ejector 604 may operate without a motor, fan, or other powered mechanical device, which may help reduce the cost and/or complexity of the probe-ejector assembly 500.

Figure 7:
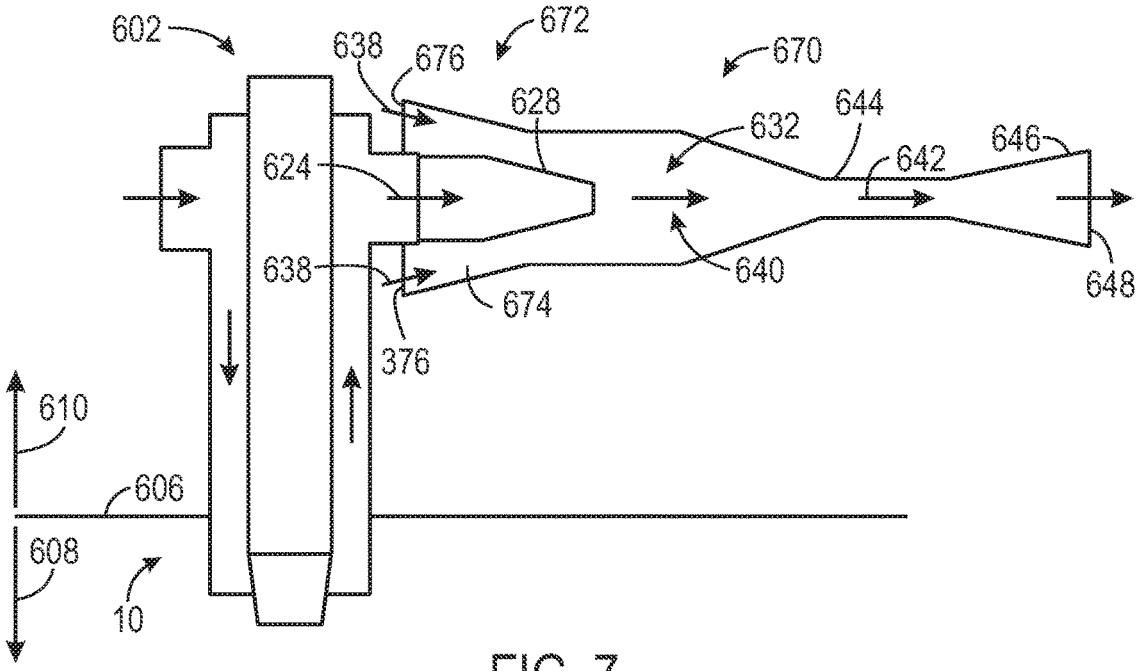
FIG. 7 is a cross-sectional view of an embodiment of a probe-ejector assembly.

FIG. 7 is a cross-sectional view of another embodiment of the probe-ejector assembly 500 (e.g., an eighth probe-ejector assembly 670) in accordance with the present disclosure. The eighth probe-ejector assembly 670 is similar to the seventh probe-ejector assembly 600 except that the eighth probe-ejector assembly 670 includes an ejector 672 that has a different coolant passage 674. More specifically, while the ejector 604 as illustrated in FIG. 6 includes the coolant passage 634 that is generally perpendicular to the nozzle 628, the ejector 672 as illustrated in FIG. 7 includes the coolant passage 674 that is generally annular and concentric with the nozzle 628. Similarly, as the outflow 624 flows through the nozzle 628, the velocity of the outflow 624 increases and the low pressure area 632 forms at or near the exit of the nozzle 628. The low pressure area 632 creates a suction force within the coolant passage 674 of the ejector 604. The coolant passage 674 includes an opening 676 through which the coolant 638 may flow. The suction force within the coolant passage 674 created by the low pressure area 632 draws the coolant 638 into the coolant passage 674 through the opening 676. The coolant 638 flows into the coolant passage 674 and, subsequently, flows into the mixing portion 640 (e.g., downstream of the low pressure area 632) where the coolant 638 mixes with the outflow 624 to form a discharge flow 642. The mixing portion 640 is a converging conduit or section, such as a conical conduit. Thereafter, the discharge flow 642 continues through the throat portion 644 (e.g., a reduced width conduit or minimum diameter section, such as a venturi section) and the diffuser portion 646 (e.g., a diverging conduit or section) to exit the ejector 672 through the ejector outlet 648. In some embodiments, the ejector 672 may include a door (e.g., similar to the door 660 of FIG. 6) coupled to the opening 676. The door may be controlled (e.g., via a controller) to change the size of the opening 676, thereby adjusting the flow rate and/or amount of the coolant 638 through the opening 636.

Figure 8:
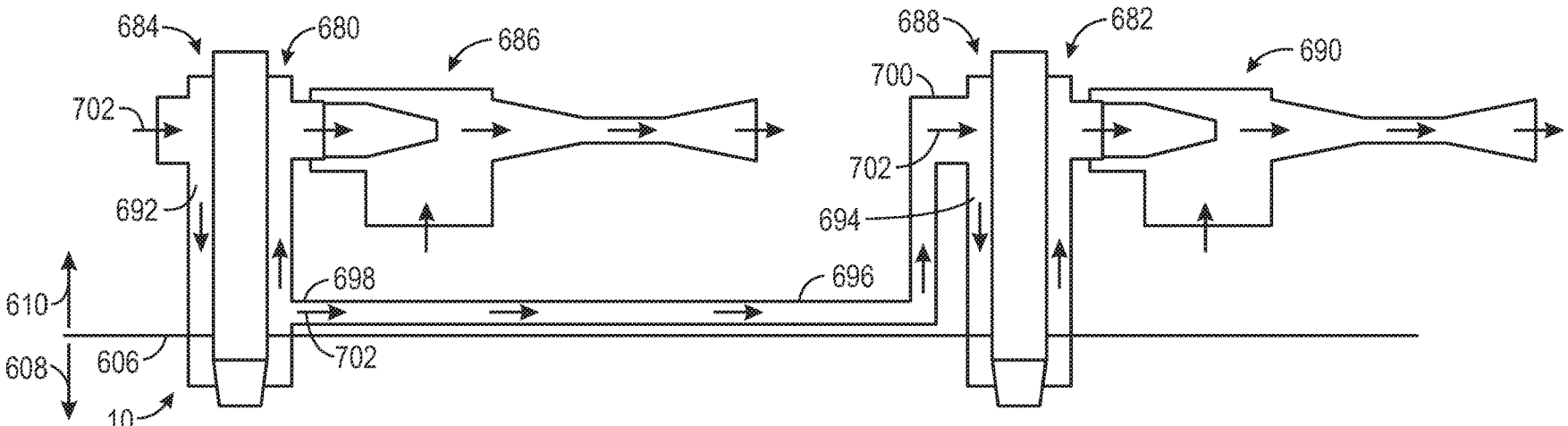
FIG. 8 is a cross-sectional view of an embodiment of multiple probe-ejector assemblies arranged in series.

FIG. 8 is a cross-sectional view of an embodiment of multiple probe-ejector assemblies 500 (e.g., a ninth probe-ejector assembly 680 and a tenth probe-ejector assembly 682) arranged in series. The ninth probe-ejector assembly 680 and the tenth probe-ejector assembly 682 are generally the same as the seventh probe-ejector assembly 600 of FIG. 6. The ninth probe-ejector assembly 680 includes a probe 684 coupled to an ejector 686. The tenth probe-ejector assembly 682 includes a probe 688 coupled to an ejector 690. While the ejectors 686, 690 are illustrated to have the same configuration as the ejector 604 of FIG. 6 (e.g., perpendicular coolant passage 634), it should be noted that the ejectors 686, 690 may have the same configuration as the ejector 672 of FIG. 7 (e.g., concentric coolant passage 674) or may have different configurations with one another (e.g., one with perpendicular coolant passage 634 and the other with concentric coolant passage 674).

The probe 684 includes a cooling passage 692. The probe 688 includes a cooling passage 694. A flow path 696 (e.g., a conduit, a passage, a line, or the like) couples the cooling passages 692 and 694 from an opening 698 on the cooling passage 692 to an inlet 700 of the cooling passage 694. As such, a cooling inflow 702 may flow through the cooling passage 692 (or a portion thereof) and the cooling passage 694 in series to exchange heat with both of the probes 684 and 688. While two of the probe-ejector assemblies 500 are illustrated in FIG. 8, it should be noted that any number (e.g., 1, 3, 4, 5, 6, 7, 8, 9, 10, or more) of the probe-ejector assemblies 500 may be coupled to one another in a similar way (e.g., in series through cooling passages, such as via one or more serial flow paths 696).

Figure 9:
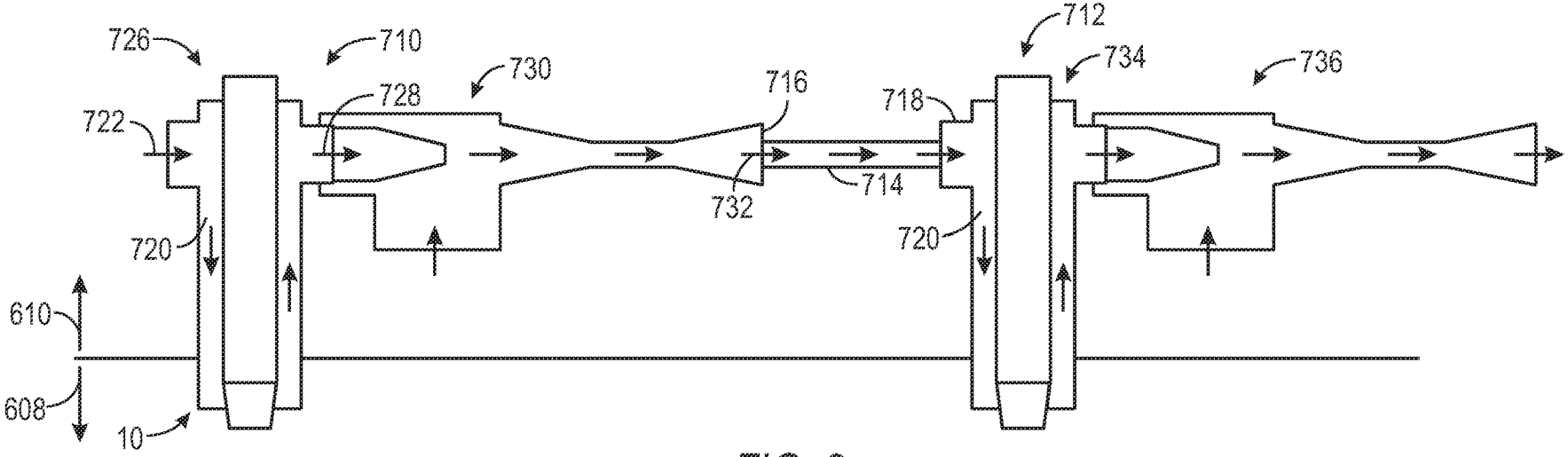
FIG. 9 is a cross-sectional view of an embodiment of multiple probe-ejector assemblies arranged in series.

FIG. 9 is a cross-sectional view of another embodiment of multiple probe-ejector assemblies 500 (e.g., an eleventh probe-ejector assembly 710 and a twelfth probe-ejector assembly 712) arranged in series. Instead of being coupled in series through cooling passages (e.g., with the flow path 696), the eleventh probe-ejector assembly 710 and the twelfth probe-ejector assembly 712 are coupled to one another via a flow path 714 (e.g., a conduit, a passage, a line, or the like) from an injector outlet 716 of the eleventh probe-ejector assembly 710 to an inlet 718 of a cooling passage 720 of the twelfth probe-ejector assembly 712. As such, a cooling inflow 722 may flow through a cooling passage 724 of the eleventh probe-ejector assembly 710 and absorb heat from a probe 726 of the eleventh probe-ejector assembly 710 to become a heated outflow 728. The outflow 728 may then flow through an ejector 730 of the eleventh probe-ejector assembly 710 and may be cooled and decelerated to exit the ejector 730 as a discharge flow 732. At least a portion of the discharge flow 732 may flow through the flow path 714 to the cooling passage 720 of the twelfth probe-ejector assembly 712 as a cooling flow for a probe 734 of the twelfth probe-ejector assembly 712. The discharge flow 732 may then flow through an ejector 736 of the twelfth probe-ejector assembly 712, being cooled, decelerated, and released to the atmosphere. Similarly, any number (e.g., 1, 2, 3, 4, 5, 6, 7, 8, 9, 10, or more) of the probe-ejector assemblies 500 may be coupled to one another in series through one ejector and the next cooling passage. Also, the ejectors (e.g., ejectors 730, 736) may have the same configuration as the ejector 604 of FIG. 6 or the ejector 672 of FIG. 7 or may have different configurations with one another. In some embodiments, the eleventh probe-ejector assembly 710 and the twelfth probe-ejector assembly 712 are disposed in close proximity and aligned with one another such that the flow path 714 may be omitted and at least a portion of the discharge flow 732 may flow directly to the cooling passage 720 of the twelfth probe-ejector assembly 712.

Figure 10:
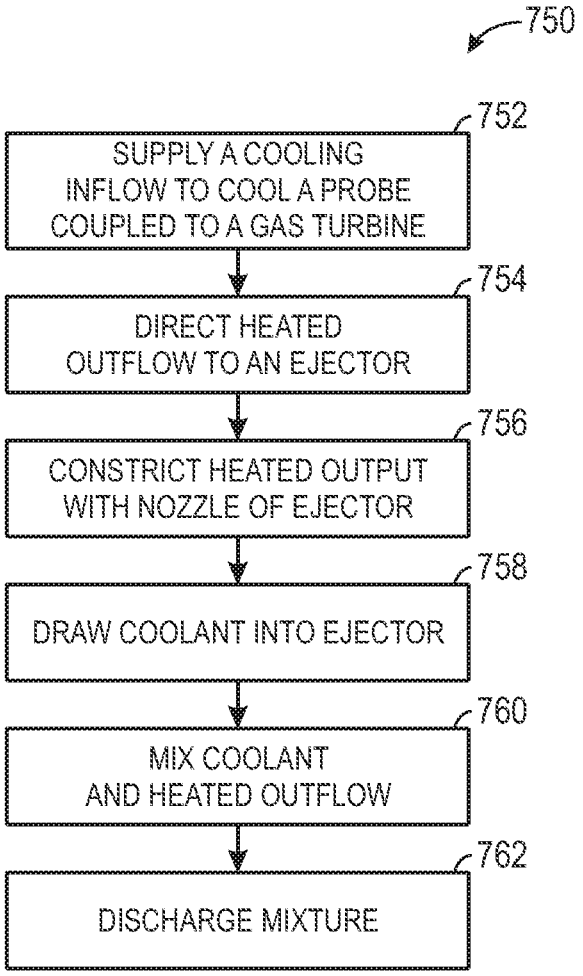
FIG. 10 is a flow diagram of an embodiment of a method for cooling and decelerating an outflow exiting a probe using an ejector.

FIG. 10 is a flow diagram of an embodiment of a method 750 for cooling and decelerating an outflow (e.g., the outflow 624) exiting a cooling passage (e.g., the cooling passage 616) of a probe (e.g., the probe 602) using an ejector (e.g., the ejectors 604, 672). The method 750 is described herein with respect to the probe-ejector assembly 600 of FIG. 6. However, it should be noted that the method 750 is similarly applicable to any of the probe-ejector assemblies 500 described above (e.g., as in FIGS. 5, 7-9).

The method 750 may start when the cooling inflow 622 is supplied (block 752) to cool the probe 602 coupled to a component of the system 10, including the hydrocarbon production system 12 and the turbine-based service system 14. The component of the system 10 and, consequently, the probe 602, may operate in high temperature conditions. As such, the cooling inflow 622 may be used to cool the probe 602. The probe 602 includes the cooling passage 616 disposed along at least a portion of the probe 602. The cooling inflow 622 flows through the cooling passage 616 to absorb heat from the probe 602, thereby forming the heated outflow 624.

The outlet 620 of the probe 602 is fluidly coupled to the ejector inlet 626. The outflow 624 is directed (block 754) to the ejector 604 from the outlet 620 of the probe 602 via the ejector inlet 626. The outflow 624 is constricted (block 756) by the nozzle 628 of the ejector inlet 626. Due to the constriction by the nozzle 628, the velocity of the outflow 624 increases and the low pressure area 632 forms at or near the exit of the nozzle 628. The low pressure area 632 creates a suction force, and the coolant 638 (e.g., ambient air) is drawn (block 758) into the interior 630 of the ejector 604. The coolant 638 is mixed (block 760) with the outflow 624 in the interior 630 to form the mixture (e.g., the discharge flow 642). Thereafter, the discharge flow 642 continues through the ejector 604 (e.g., the throat portion 644 and the diffuser portion 646) and is discharged (block 762) from the ejector 604 through the ejector outlet 648.

As discussed above, the coolant 638 has a lower temperature than the outflow 624 and, when mixing with the outflow 624 in the ejector 604, decreases the temperature of the outflow 624. In addition, the ejector 604 is also formed in such a shape to increase the sectional area of the interior 630, thereby having an effect of reducing the velocity of the mixture of the outflow 624 and the coolant 638 as the mixture flowing through the throat portion 644 and the diffuser portion 646. Accordingly, the discharge flow 642 exiting the ejector 604 may have a lower temperature and a lower velocity than the outflow 624 entering the ejector 604. Consequently, the discharge flow 642 may be released directly into the atmosphere without separate piping or heat exchangers to cool and reduce the velocity of the outflow 624.

This written description uses examples to disclose the embodiments, including the best mode, and also to enable any person skilled in the art to practice the present disclosure, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

ADDITIONAL DESCRIPTION

The present embodiments provide a system and method for cooling and decelerating discharge flows from probes coupled to a gas turbine system. It should be noted that any one or a combination of the features described above may be utilized in any suitable combination. Indeed, all permutations of such combinations are presently contemplated. By way of example, the following clauses are offered as further description of the present disclosure:

Embodiment 1

A system includes a probe. The probe includes a sensing component configured to sense a parameter of a turbomachine. The probe also includes an inlet configured to receive a cooling inflow. The probe also includes a cooling passage configured to receive the cooling inflow from the inlet, wherein the cooling passage is disposed along at least a portion of the probe, and the cooling inflow absorbs heat from the probe. The probe also includes an outlet coupled to the cooling passage and configured to receive an outflow from the cooling passage, wherein the outflow includes at least a portion of the cooling inflow. The system also includes an ejector coupled to the outlet. The ejector includes an interior. The ejector also includes an opening fluidly coupled to the interior, wherein the opening is configured to receive a coolant. The ejector also includes a nozzle coupled to the outlet, wherein the nozzle is configured to constrict the outflow from the outlet and to deliver the outflow to the interior. The ejector also includes a mixing portion configured to mix the outflow and the coolant to provide a discharge flow.

Embodiment 2

The system of embodiment 1, wherein the probe includes a lambda probe and the parameter includes an oxygen content of a working flow of the turbomachine, and the turbomachine includes a gas turbine engine.

Embodiment 3

The system of any preceding embodiment, wherein the probe includes a temperature probe and the parameter includes a temperature of a portion of the turbomachine.

Embodiment 4

The system of any preceding embodiment, wherein the probe includes a flow-sensing probe and the parameter includes a flow rate of a working flow of the turbomachine.

Embodiment 5

The system of any preceding embodiment, wherein the cooling inflow includes air, carbon dioxide, nitrogen, or any combination thereof.

Embodiment 6

The system of any preceding embodiment, wherein the turbomachine includes a gas turbine engine, and the cooling inflow includes a recirculated exhaust gas of the gas turbine engine.

Embodiment 7

The system of any preceding embodiment, wherein the coolant includes ambient air, wherein a temperature of the ambient air is less than approximately 40° C.

Embodiment 8

The system of any preceding embodiment, wherein the sensing component of the probe is disposed at an axial end of the probe, and cooling passage directs the cooling inflow along an axis of the probe towards the axial end.

Embodiment 9

The system of any preceding embodiment, wherein the system includes the gas turbine engine, wherein the gas turbine engine includes a turbine combustor, a turbine driven by combustion gases from the turbine combustor and that outputs an exhaust gas, and an exhaust gas compressor driven by the turbine, wherein the exhaust gas compressor is configured to compress and to route the exhaust gas to the turbine combustor.

Embodiment 10

The system of embodiment 9, wherein the gas turbine engine is a stoichiometric exhaust gas recirculation (SEGR) gas turbine engine.

Embodiment 11

The system of embodiment 10, wherein the system includes an exhaust gas extraction system coupled to the gas turbine engine, and a hydrocarbon production system coupled to the exhaust gas extraction system.

Embodiment 12

The system of any preceding embodiment, wherein the ejector includes a converging section, a throat disposed downstream of the converging section, and a diverging section disposed downstream of the throat, wherein the nozzle is disposed upstream of the converging section, and the mixing portion is disposed in the converging section.

Embodiment 13

A system includes a probe. The probe includes a sensing component configured to sense a parameter of a gas turbine engine. The probe also includes an inlet configured to receive a cooling inflow. The probe also includes a cooling passage configured to receive the cooling inflow from the inlet, wherein the cooling passage is disposed along at least a portion of the probe, and the cooling inflow absorbs heat from the probe to form a heated outflow. The probe also includes an outlet coupled to the cooling passage and configured to receive the heated outflow from the cooling passage, wherein a temperature of the heated outflow at the outlet is greater than 80° C. The system also includes an ejector coupled to the outlet. The ejector includes an interior. The ejector also includes an opening fluidly coupled to the interior, wherein the opening is configured to receive a coolant. The ejector also includes a nozzle coupled to the outlet, wherein the nozzle is configured to constrict the heated outflow from the outlet and to deliver the heated outflow to the interior. The ejector also includes a mixing portion configured to mix the heated outflow and the coolant to provide a discharge flow, wherein a temperature of the discharge flow is less than 80° C.

Embodiment 14

The system of embodiment 13, wherein the probe includes a lambda probe and the parameter includes an oxygen content of a working flow of the gas turbine engine.

Embodiment 15

The system of embodiments 13 or 14, wherein the probe includes a temperature probe and the parameter includes a temperature of a portion of the gas turbine engine.

Embodiment 16

The system of embodiments 13, 14, or 15, wherein the probe includes a flow-sensing probe and the parameter includes a flow rate of a working flow of the gas turbine engine.

Embodiment 17

The system of embodiments 13, 14, 15, or 16, wherein the cooling inflow includes air, carbon dioxide, nitrogen, or any combination thereof.

Embodiment 18

The system of embodiments 13, 14, 15, 16, or 17, wherein the coolant includes ambient air, and a temperature of the ambient air is less than approximately 40° C.

Embodiment 19

The system of embodiments 13, 14, 15, 16, 17, or 18, wherein the nozzle includes a nozzle outlet adjacent to the interior, the nozzle outlet includes a first diameter, the outlet of the probe includes a second diameter, and the first diameter is greater than the second diameter.

Embodiment 20

The system of embodiments 13, 14, 15, 16, 17, 18, or 19, wherein the ejector includes a door coupled to the opening, wherein the door is configured to control a flow rate of the coolant through the opening.

Embodiment 21

A method includes supplying a cooling inflow to a probe configured to sense a parameter of a gas turbine engine, wherein the cooling inflow is configured to absorb heat from the probe to form a heated outflow. The method also includes directing the heated outflow from the probe to an ejector, wherein the ejector includes a nozzle coupled to an outlet of the probe. The method also includes constricting the heated outflow through the nozzle into an interior of the ejector to draw a coolant into the interior of the ejector via an opening. The method also includes mixing the heated outflow and the coolant to form a discharge flow in a mixing portion of the ejector. The method also includes directing the discharge flow to an ejector outlet of the ejector, wherein a temperature of the discharge flow is less than 80° C.

Embodiment 22

The method of embodiment 21, wherein the probe includes a lambda probe and the parameter includes an oxygen content of a working flow of the gas turbine engine, the probe includes a temperature probe and the parameter includes a temperature of a portion of the gas turbine engine, the probe includes a flow-sensing probe and the parameter includes a flow rate of a working flow of the gas turbine engine, or any combination thereof.

Embodiment 23

The method of embodiments 21 or 22, wherein the cooling inflow includes air, carbon dioxide, nitrogen, or any combination thereof.

Embodiment 24

The method of embodiments 21, 22, or 23, wherein the coolant includes ambient air, wherein a temperature of the ambient air is less than approximately 40° C.

Embodiment 25

The method of embodiments 21, 22, 23, or 24, where the method includes controlling a size of the opening to adjust a flow rate of the coolant based at least in part on a temperature of the discharge flow.

The invention claimed is:

1. A system comprising:

a first probe disposed through one or more walls of a turbomachine, comprising:

a sensing component configured to sense a parameter of a turbomachine, wherein the sensing component is disposed on a warm side of the one or more walls;

a first body coupled to the sensing component;

a first inlet configured to receive a first cooling inflow, wherein the first inlet is disposed on a cool side of the one or more walls;

a first shell coupled to the first inlet, wherein the first shell defines a first cooling passage that extends through the one or more walls of the turbomachine, wherein the first cooling passage is configured to direct the first cooling inflow from the first inlet toward the sensing component of the first probe and toward a first outlet coupled to the first shell; and the first outlet, wherein the first outlet is disposed on the cool side of the one or more walls, and the first outlet is configured to receive a first outflow from the first cooling passage, wherein the first outflow comprises at least a first portion of the first cooling inflow; and an ejector coupled to the first outlet, wherein the ejector is configured to mix a coolant with the first outflow to reduce a temperature and a velocity of the first outflow.

2. The system of claim 1, wherein the first probe comprises a lambda probe, a temperature probe, a flow-sensing probe, or a composition.

3. The system of claim 1, wherein the first body of the first probe comprises a processor, a memory, or any combination thereof.

4. The system of claim 1, wherein the first cooling inflow comprises air, carbon dioxide, nitrogen, or any combination thereof.

5. The system of claim 1, comprising the turbomachine, wherein the turbomachine comprises a gas turbine engine, and the first cooling inflow comprises a recirculated exhaust gas of the gas turbine engine.

6. The system of claim 1, wherein the turbomachine comprises a gas turbine engine, and the one or more walls comprise a compressor discharge casing of the gas turbine engine.

7. The system of claim 1, wherein the turbomachine comprises a gas turbine engine, and the one or more walls comprise a combustor liner of the gas turbine engine, a flow sleeve of the gas turbine engine, or any combination thereof.

8. The system of claim 1, wherein the cool side of the one or more walls is disposed in a first environment with a first temperature less than 40° C., and the warm side of the one or more walls is disposed in a second environment with a second temperature greater than 200° C. during operation of the turbomachine.

9. The system of claim 8, wherein the first cooling passage is closed from the second environment, and the first outflow consists essentially of the first cooling inflow.

10. The system of claim 1, comprising a second probe, comprising:

a second body;

a second inlet configured to receive a second cooling inflow from an opening coupled to the cooling passage of the first probe, wherein the opening is disposed between the first inlet and the first outlet, and the second cooling inflow comprises a second portion of the first cooling inflow;

a second shell coupled to the second inlet, wherein the second shell defines a second cooling passage configured to receive the second cooling flow from the second inlet, and the second cooling flow is configured to absorb heat from the second probe; and a second outlet coupled to the second shell, wherein the second outlet is configured to receive a second outflow from the second cooling passage, wherein the second outflow comprises the second cooling flow.

11. A gas turbine system comprising:

a probe disposed through a wall of the gas turbine system, comprising:

a sensing component configured to sense a parameter of working fluid of a gas turbine engine, wherein the sensing component is disposed on a warm side of the wall, wherein the warm side of the wall is disposed in an environment with a second temperature greater than 200° C. during operation of the gas turbine system;

a body coupled to the sensing component;

an inlet configured to receive a cooling inflow, wherein the inlet is disposed on a cool side of the wall with a first temperature less than 40° C.;

a shell coupled to the inlet, wherein the shell defines a cooling passage that extends through the one or more walls of the turbomachine, wherein the cooling passage is configured to direct the cooling inflow from the inlet toward the sensing component along at least a length of the probe and toward an outlet coupled to the shell, wherein the cooling inflow is configured to absorb heat from the probe to form a heated outflow; and the outlet, wherein the outlet is disposed on the cool side of the wall, and the outlet is configured to receive the heated outflow from the cooling passage; and an ejector coupled to the outlet, wherein the ejector is configured to mix a coolant with the heated outflow to reduce a temperature and a velocity of the heated outflow.

12. The gas turbine system of claim 11, wherein the probe comprises a lambda probe, a temperature probe, a flow-sensing probe, or a composition probe.

13. The gas turbine system of claim 11, wherein the wall comprises a casing of the gas turbine system, a flow sleeve of the gas turbine system, or a combustor liner of the gas turbine system, or any combination thereof.

14. The gas turbine system of claim 11, wherein the working fluid comprises combustion gases of the gas turbine system, a recirculated exhaust gas of the gas turbine system, or any combination thereof.

15. A method comprising:

supplying a first cooling inflow to a first inlet of a first probe disposed on a cool side of a wall of a gas turbine system;

directing the first cooling inflow through a first cooling passage disposed longitudinally along at least a first length of a first body of the first probe toward an axial end of the first probe disposed on a warm side of the wall, wherein the first probe is configured to sense a first parameter of the gas turbine system, wherein the first cooling inflow is configured to absorb heat from the first probe to form a first heated outflow;

directing the first heated outflow from the axial end of the first probe to a first outlet, wherein the first outlet is disposed on the cool side of the wall of the gas turbine system;

directing the first heated outflow to a second inlet of a second probe of the gas turbine system; and directing the first heated inflow through a second cooling passage disposed longitudinally along at least a second length of a second body of the second probe, wherein the second probe is configured to sense a second parameter of the gas turbine system, wherein the first heated outflow is configured to absorb heat from the second probe to form a second heated outflow.

16. The method of claim 15, comprising sensing the first parameter of the gas turbine system, wherein the first parameter comprises an oxygen content, a temperature, a flow rate, or any combination thereof.

17. The method of claim 15, wherein supplying the first cooling inflow to the first probe comprises supplying air, carbon dioxide, nitrogen, recirculated exhaust gas, or any combination thereof.

* * * * *